US011410607B2

(12) United States Patent
Roh et al.

(10) Patent No.: US 11,410,607 B2
(45) Date of Patent: Aug. 9, 2022

(54) ORGANIC LIGHT EMITTING DIODE DISPLAY DEVICE

(71) Applicant: SAMSUNG DISPLAY CO., LTD., Yongin-si (KR)

(72) Inventors: Jinyoung Roh, Hwaseong-si (KR); Hongsoo Kim, Hwaseong-si (KR); Sehyuk Park, Seongnam-si (KR); Hyojin Lee, Seongnam-si (KR); Jaekeun Lim, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/306,259

(22) Filed: May 3, 2021

(65) Prior Publication Data

US 2022/0044635 A1 Feb. 10, 2022

(30) Foreign Application Priority Data

Aug. 4, 2020 (KR) ..... 10-2020-0097322

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC .. G09G 3/3208; G09G 3/3233; G09G 3/3258; G09G 3/3266; G09G 3/3291; G09G 2300/0439; G09G 2300/0809; G09G 2300/0819; G09G 2300/0842; G09G 2310/0202; G09G 2310/0262; G09G 2310/0278; G09G 2310/0286; G09G 2310/0297; G09G 2310/061; G09G 2310/08; G09G 2320/103; G09G 2320/02; G09G 2320/0214; G09G 2320/0233; G09G 2320/0242; G09G 2320/0257;
(Continued)

(56) References Cited

U.S. PATENT DOCUMENTS 10,818,230 B1 * 10/2020 Lu ..... G09G 3/3233
2016/0240565 A1 * 8/2016 Kim ..... H01L 27/0922
(Continued)

*Primary Examiner* — Michael J Eurice
(74) *Attorney, Agent, or Firm* — F. Chau & Associates, LLC

(57) ABSTRACT

An organic light emitting diode display device includes a display panel including a plurality of pixels, and a panel driver configured to drive the display panel. Each pixel includes a driving transistor, a compensating transistor including first and second compensating sub-transistors coupled in series between a gate node and a drain of the driving transistor, a storage capacitor, and an organic light emitting diode. The panel driver calculates an average representative gray level of input image data in a plurality of frame periods, determines a voltage level of a node controlling voltage based on the average representative gray level, and provides the node controlling voltage to each of the plurality of pixels to control a voltage of a node between the first and second compensating sub-transistors.

20 Claims, 12 Drawing Sheets

(51) Int. Cl.
*G09G 3/3291* (2016.01)
*G09G 3/3266* (2016.01)

(52) U.S. Cl.
CPC ... *G09G 3/3233* (2013.01); *G09G 2300/0819* (2013.01); *G09G 2300/0842* (2013.01); *G09G 2320/02* (2013.01); *G09G 2320/103* (2013.01); *G09G 2360/16* (2013.01)

(58) Field of Classification Search
CPC ..... G09G 2330/021; G09G 2330/028; G09G 2320/043; G09G 2320/045; G09G 2340/0435; G09G 2360/16
See application file for complete search history.

(56) References Cited

U.S. PATENT DOCUMENTS

| | | | | |
|---|---|---|---|---|
| 2017/0169773 | A1* | 6/2017 | Cao | G09G 3/3607 |
| 2018/0130424 | A1* | 5/2018 | Gao | G09G 3/3291 |
| 2018/0151123 | A1* | 5/2018 | Li | G09G 3/3233 |
| 2018/0190194 | A1* | 7/2018 | Zhu | H01L 27/12 |
| 2020/0342814 | A1* | 10/2020 | Teraguchi | H01L 27/3248 |
| 2021/0174746 | A1* | 6/2021 | Zhang | G09G 3/3258 |

* cited by examiner

ORGANIC LIGHT EMITTING DIODE DISPLAY DEVICE

CROSS-REFERENCE TO RELATED APPLICATION(S)

This application claims priority under 35 USC § 119 to Korean Patent Application No. 10-2020-0097322, filed on Aug. 4, 2020 in the Korean Intellectual Property Office (KIPO), the entire content of which is incorporated by reference.

FIELD

The present disclosure relates to display devices, and more particularly to an organic light emitting diode (OLED) display device.

DISCUSSION OF RELATED ART

Each pixel of an organic light emitting diode (OLED) display device may store a data voltage at a gate node by using a storage capacitor, and may display an image with a desired luminance corresponding to the stored data voltage. However, the data voltage stored at the gate node might be distorted by a leakage current from the gate node or to the gate node, and the pixel might not emit light with the desired luminance. In particular, in a case where the OLED display device performs a low frequency operation that drives a display panel at a lower than normal driving frequency, the distortion of the stored data voltage caused by the leakage current might be intensified, and an image quality of the OLED display device might be degraded.

SUMMARY

An embodiment provides an organic light emitting diode (OLED) display device capable of reducing a leakage current in each pixel.

According to an embodiment, an OLED display device includes a display panel having a plurality of pixels, and a panel driver configured to drive the display panel. Each of the plurality of pixels includes a driving transistor having a gate electrode coupled to a gate node and a source configured to receive a data voltage, a compensating transistor configured to diode-connect the driving transistor, the compensating transistor including first and second compensating sub-transistors coupled in series between the gate node and a drain of the driving transistor, a storage capacitor configured to store the data voltage transferred through the switching transistor and the diode-connected driving transistor, and an organic light emitting diode configured to emit light based on a driving current generated by the driving transistor. The panel driver calculates an average representative gray level of input image data in a plurality of frame periods, determines a voltage level of a node controlling voltage based on the average representative gray level, and provides the node controlling voltage to each of the plurality of pixels to control a voltage of a node between the first and second compensating sub-transistors.

In an embodiment, at least one of the first and second compensating sub-transistors may include a bottom electrode, and the node controlling voltage may be a bottom electrode voltage applied to the bottom electrode.

In an embodiment, each of the plurality of pixels may further include a reference transistor configured to apply a reference voltage to the node between the first and second compensating sub-transistors, and the node controlling voltage may be the reference voltage.

In an embodiment, the average representative gray level may be an average of a plurality of representative gray levels of the input image data in the plurality of frame periods, and each of the plurality of representative gray levels may be an average gray level of gray levels represented by the input image data in a corresponding frame period of the plurality of frame periods.

In an embodiment, the average representative gray level may be an average of a plurality of representative gray levels of the input image data in the plurality of frame periods, and each of the plurality of representative gray levels may be a middle gray level, a maximum gray level or a minimum gray level of gray levels represented by the input image data in a corresponding frame period of the plurality of frame periods.

In an embodiment, the plurality of frame periods may include at least one previous frame period and a current frame period. The panel driver may store a previous frame representative gray level in the at least one previous frame period, may calculate a current frame representative gray level based on the input image data in the current frame period, may calculate the average representative gray level by calculating an average of the previous frame representative gray level and the current frame representative gray level, and may determine the voltage level of the node controlling voltage corresponding to the average representative gray level.

In an embodiment, the panel driver may include a data driver configured to provide the data voltage to each of the plurality of pixels, a gate driver configured to provide a gate signal to each of the plurality of pixels, a power management circuit configured to provide the node controlling voltage to each of the plurality of pixels, and a controller configured to control the data driver, the gate driver and the power management circuit. The controller may include a previous gray storing block configured to store a previous frame representative gray level in at least one previous frame period, a current gray calculating block configured to calculate a current frame representative gray level based on the input image data in a current frame period, an average gray calculating block configured to calculate the average representative gray level by calculating an average of the previous frame representative gray level and the current frame representative gray level, and a voltage level determining block configured to determine the voltage level of the node controlling voltage corresponding to the average representative gray level.

In an embodiment, each of the plurality of pixels may further include a gate initializing transistor configured to apply an initialization voltage to the gate node in response to a gate initialization signal, the gate initializing transistor including first and second gate initializing sub-transistors coupled in series between the gate node and a line of the initialization voltage, a first emitting transistor configured to couple a line of a power supply voltage and the source of the driving transistor in response to an emission signal, a second emitting transistor configured to couple the drain of the driving transistor and the organic light emitting diode in response to the emission signal, and an anode initializing transistor configured to apply the initialization voltage to the organic light emitting diode in response to a gate bypass signal. At least one of the first and second compensating sub-transistors may include a first bottom electrode, at least one of the first and second gate initializing sub-transistors may include a second bottom electrode, and the node controlling voltage may be a bottom electrode voltage applied to the first and second bottom electrodes.

In an embodiment, each of the plurality of pixels may further include a gate initializing transistor configured to apply an initialization voltage to the drain of the driving transistor in response to a gate initialization signal, a first emitting transistor configured to couple a line of a power supply voltage and the source of the driving transistor in response to an emission signal, and a second emitting transistor configured to couple the drain of the driving transistor and the organic light emitting diode in response to the emission signal. At least one of the first and second compensating sub-transistors may include a bottom electrode, and the node controlling voltage may be a bottom electrode voltage applied to the bottom electrode.

In an embodiment, each of the plurality of pixels may further include a gate initializing transistor configured to apply an initialization voltage to the gate node in response to a gate initialization signal, the gate initializing transistor including first and second gate initializing sub-transistors coupled in series between the gate node and a line of the initialization voltage, a first emitting transistor configured to couple a line of a power supply voltage and the source of the driving transistor in response to an emission signal, a second emitting transistor configured to couple the drain of the driving transistor and the organic light emitting diode in response to the emission signal, an anode initializing transistor configured to apply the initialization voltage to the organic light emitting diode in response to a gate bypass signal, a first reference transistor configured to apply a reference voltage to the node between the first and second compensating sub-transistors, and a second reference transistor configured to apply the reference voltage to a node between the first and second gate initializing sub-transistors. The node controlling voltage may be the reference voltage.

In an embodiment, each of the plurality of pixels may further include a gate initializing transistor configured to apply an initialization voltage to the drain of the driving transistor in response to a gate initialization signal, a first emitting transistor configured to couple a line of a power supply voltage and the source of the driving transistor in response to an emission signal, a second emitting transistor configured to couple the drain of the driving transistor and the organic light emitting diode in response to the emission signal, and a reference transistor configured to apply a reference voltage to the node between the first and second compensating sub-transistors. The node controlling voltage may be the reference voltage.

In an embodiment, the panel driver may include a still image detector configured to determine whether the input image data represent a moving image or a still image, to determine a driving mode for the display panel as a moving image mode when the input image data represent the moving image, and to determine the driving mode for the display panel as a still image mode when the input image data represent the still image, and a driving frequency decider configured to determine a driving frequency for the display panel as a normal driving frequency in the moving image mode, and to determine the driving frequency for the display panel as a low frequency lower than the normal driving frequency in the still image mode.

In an embodiment, the panel driver may provide the node controlling voltage to each of the plurality of pixels in the still image mode, and might not provide the node controlling voltage to each of the plurality of pixels in the moving image mode.

In an embodiment, the panel driver may provide the node controlling voltage to each of the plurality of pixels in the still image mode and in a transition period between the still image mode and the moving image mode, and might not provide the node controlling voltage to each of the plurality of pixels in the moving image mode after the transition period.

According to an embodiment, an OLED display device includes a display panel including a plurality of pixels, and a panel driver configured to drive the display panel. Each of the plurality of pixels includes a driving transistor having a gate electrode coupled to a gate node and a source configured to receive a data voltage, a compensating transistor configured to diode-connect the driving transistor, the compensating transistor including first and second compensating sub-transistors coupled in series between the gate node and a drain of the driving transistor, a storage capacitor configured to store the data voltage transferred through the switching transistor and the diode-connected driving transistor, and an organic light emitting diode configured to emit light based on a driving current generated by the driving transistor. At least one of the first and second compensating sub-transistors includes a first bottom electrode. The panel driver calculates an average representative gray level of input image data in a plurality of frame periods, determines a voltage level of a bottom electrode voltage applied to the first bottom electrode based on the average representative gray level, and provides the bottom electrode voltage to each of the plurality of pixels.

In an embodiment, each of the plurality of pixels may further include a gate initializing transistor configured to apply an initialization voltage to the gate node in response to a gate initialization signal, the gate initializing transistor including first and second gate initializing sub-transistors coupled in series between the gate node and a line of the initialization voltage, a first emitting transistor configured to couple a line of a power supply voltage and the source of the driving transistor in response to an emission signal, a second emitting transistor configured to couple the drain of the driving transistor and the organic light emitting diode in response to the emission signal, and an anode initializing transistor configured to apply the initialization voltage to the organic light emitting diode in response to a gate bypass signal. At least one of the first and second gate initializing sub-transistors may include a second bottom electrode, and the bottom electrode voltage may be applied to the first and second bottom electrodes.

In an embodiment, each of the plurality of pixels may further include a gate initializing transistor configured to apply an initialization voltage to the drain of the driving transistor in response to a gate initialization signal, a first emitting transistor configured to couple a line of a power supply voltage and the source of the driving transistor in response to an emission signal, and a second emitting transistor configured to couple the drain of the driving transistor and the organic light emitting diode in response to the emission signal.

According to an embodiment, an OLED display device includes a display panel including a plurality of pixels, and a panel driver configured to drive the display panel. Each of the plurality of pixels includes a driving transistor having a gate electrode coupled to a gate node and a source configured to receive a data voltage, a compensating transistor configured to diode-connect the driving transistor, the compensating transistor including first and second compensating sub-transistors coupled in series between the gate node and a drain of the driving transistor, a storage capacitor configured to store the data voltage transferred through the switching transistor and the diode-connected driving transistor, an organic light emitting diode configured to emit light based on a driving current generated by the driving transistor, and a first reference transistor configured to apply a reference voltage to a node between the first and second compensating sub-transistors. The panel driver calculates an average representative gray level of input image data in a plurality of frame periods, determines a voltage level of the reference voltage based on the average representative gray level, and provides the reference voltage to each of the plurality of pixels.

In an embodiment, each of the plurality of pixels may further include a gate initializing transistor configured to apply an initialization voltage to the gate node in response to a gate initialization signal, the gate initializing transistor including first and second gate initializing sub-transistors coupled in series between the gate node and a line of the initialization voltage, a first emitting transistor configured to couple a line of a power supply voltage and the source of the driving transistor in response to an emission signal, a second emitting transistor configured to couple the drain of the driving transistor and the organic light emitting diode in response to the emission signal, an anode initializing transistor configured to apply the initialization voltage to the organic light emitting diode in response to a gate bypass signal, and a second reference transistor configured to apply the reference voltage to a node between the first and second gate initializing sub-transistors.

In an embodiment, each of the plurality of pixels may further include a gate initializing transistor configured to apply an initialization voltage to the drain of the driving transistor in response to a gate initialization signal, a first emitting transistor configured to couple a line of a power supply voltage and the source of the driving transistor in response to an emission signal, and a second emitting transistor configured to couple the drain of the driving transistor and the organic light emitting diode in response to the emission signal.

In an OLED display device according to an embodiment, each pixel may include first and second compensating sub-transistors coupled in series between a gate node and a drain of a driving transistor. A panel driver of the OLED display device may determine a voltage level of a node controlling voltage according to an average representative gray level in a plurality of frame periods, and may provide the node controlling voltage to each pixel to control a voltage of a node between the first and second compensating sub-transistors. Thus, a leakage current to the gate node may be minimized. Further, when an image displayed by the OLED display device is changed, the voltage level of the node controlling voltage may be gradually changed. Accordingly, an image quality of the OLED display device may be optimized.

According to an embodiment, a display panel has a plurality of pixels, and each of the plurality of pixels includes a driving transistor having a gate electrode coupled to a gate node, and a source configured to receive a data voltage; a compensating transistor configured to diode-connect the driving transistor, the compensating transistor including first and second compensating sub-transistors coupled in series between the gate node and a drain of the driving transistor; a storage capacitor configured to store the data voltage transferred through the diode-connected driving transistor; an organic light emitting diode configured to emit light based on a driving current generated by the driving transistor; and an average representative gray voltage level terminal responsive to an average representative gray level of input image data in a plurality of frame periods and configured to control at least one of the first and second compensating sub-transistors.

In an embodiment, the average representative gray voltage level terminal is configured to receive a node controlling voltage based on the average representative gray level to control a voltage of a node between the first and second compensating sub-transistors.

In an embodiment, at least one of the first and second compensating sub-transistors includes a first bottom electrode, and the average representative gray voltage level terminal is configured to apply a bottom electrode voltage to the first bottom electrode based on the average representative gray level.

In an embodiment, each of the plurality of pixels further includes a first reference transistor configured to apply a reference voltage to a node between the first and second compensating sub-transistors, wherein the average representative gray voltage level terminal is configured to receive the reference voltage based on the average representative gray level.

In an embodiment, each of the plurality of pixels further includes a switching transistor configured to transfer the data voltage to the source of the driving transistor.

BRIEF DESCRIPTION OF THE DRAWINGS

Illustrative, non-limiting embodiments will be more clearly understood from consideration of the following detailed description taken in conjunction with the accompanying drawings, in which.

DETAILED DESCRIPTION

Hereinafter, non-limiting embodiments of the present inventive concept will be explained in detail with reference to the accompanying drawings.

Figure 1:
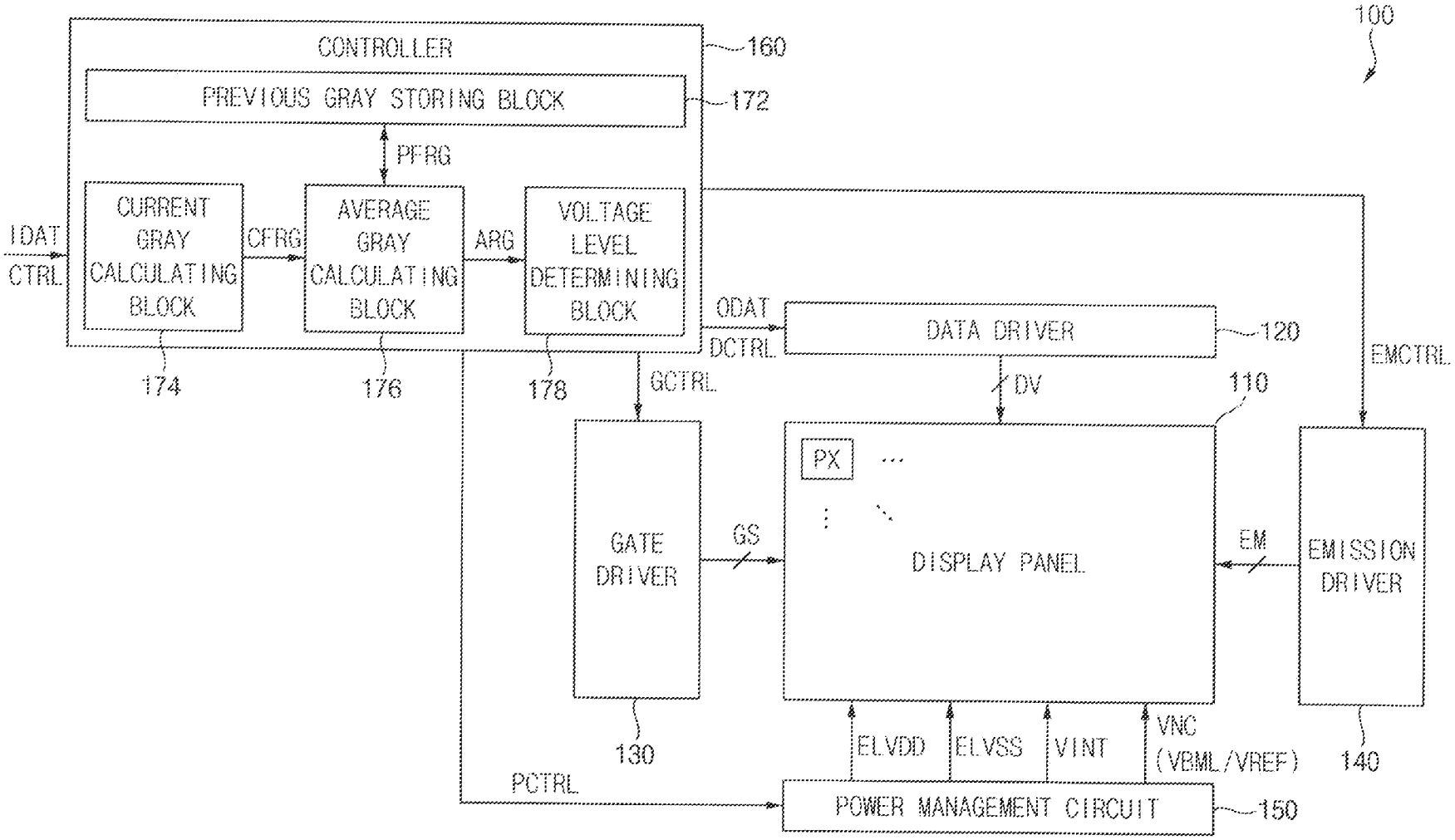
FIG. 1 is a block diagram illustrating an organic light emitting diode (OLED) display device according to an embodiment.
Figure 2:
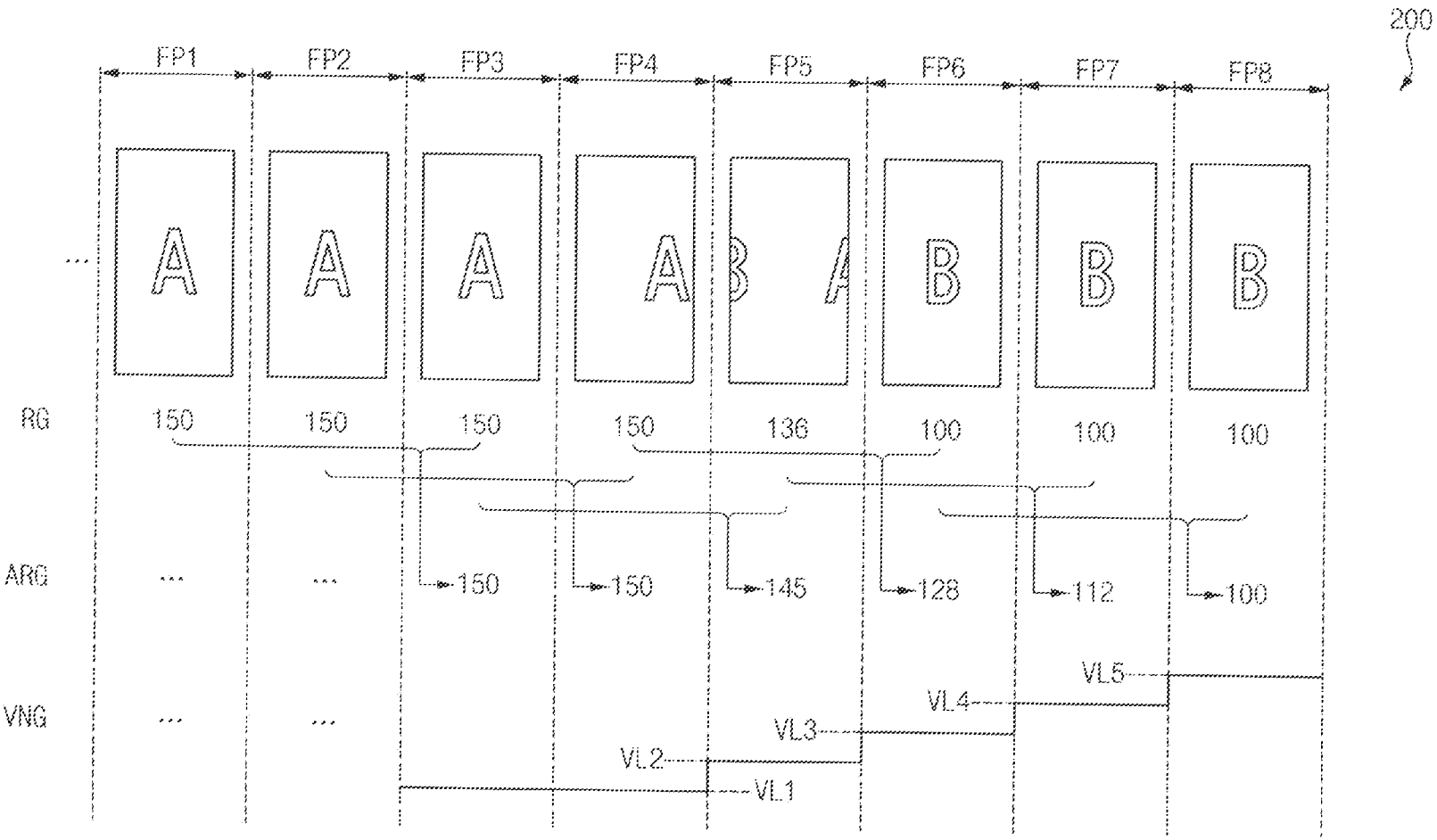
FIG. 2 is a timing diagram for describing an example where an average representative gray level is calculated, and a voltage level of a node controlling voltage is determined according to the average representative gray level in an OLED display device according to an embodiment.

FIG. 1 illustrates an organic light emitting diode (OLED) display device according to an embodiment, and FIG. 2 illustrates signal timing for an example where an average representative gray level is calculated, and a voltage level of a node controlling voltage is determined according to the average representative gray level in an OLED display device according to an embodiment.

Referring to FIG. 1, an OLED display device 100 according to an embodiment may include a display panel 110 including a plurality of pixels PX, and a panel driver that drives the display panel 110. In an embodiment, the panel driver may include a data driver 120 that provides data voltages DV to the plurality of pixels PX, a gate driver 130 that provides gate signals GS to the plurality of pixels PX, an emission driver 140 that provides emission signals EM to the plurality of pixels PX, a power management circuit 150 that provides a node controlling voltage VNC to the plurality of pixels PX, and a controller 160 that controls the data driver 120, the gate driver 130, the emission driver 140 and the power management circuit 150.

The display panel 110 may include the plurality of pixels PX. In an embodiment, each pixel PX may include a driving transistor that has a gate electrode coupled to a gate node, a switching transistor that transfers the data voltage DV to a source of the driving transistor, a compensating transistor that diode-connects the driving transistor, a storage capacitor that stores the data voltage DV transferred through the switching transistor and the diode-connected driving transistor at the gate node, and an organic light emitting diode that emits light based on a driving current generated based on the data voltage DV stored at the gate node by the driving transistor.

In each pixel PX, the data voltage DV stored at the gate node might be distorted by a leakage current from the gate node or to the gate node, and the organic light emitting diode might not emit light with a desired luminance. For example, the leakage current from the gate node or to the gate node might flow through the compensating transistor having a source/drain coupled to the gate node, and the data voltage DV might be distorted by the leakage current of the compensating transistor. In particular, in a case where the OLED display device 100 performs a low frequency operation that drives the display panel 110 at a low frequency that is lower than a normal driving frequency, a distortion of the stored data voltage DV caused by the leakage current might be intensified, and an image quality of the OLED display device 100 might be degraded.

However, in each pixel PX of the OLED display device 100 according to an embodiment, the compensating transistor having the source/drain coupled to the gate node may be implemented with a dual transistor or a double gate transistor. That is, the compensating transistor may include first and second compensating sub-transistors coupled in series between the gate node and a drain of the driving transistor. Accordingly, the leakage current of the compensating transistor from the drain of the driving transistor to the gate node may be minimized, and the image quality of the OLED display device 100 may be improved.

The data driver 120 may generate the data voltages DV based on output image data ODAT and a data control signal DCTRL received from the controller 160, and may provide the data voltages DV to the plurality of pixels PX. In an embodiment, the data control signal DCTRL may include, but is not limited to, an output data enable signal, a horizontal start signal and/or a load signal.

In an embodiment, the data driver 120 and the controller 160 may be implemented with a signal integrated circuit, and the signal integrated circuit may be referred to as a timing controller embedded data driver (TED). In another embodiment, the data driver 120 and the controller 160 may be implemented with separate integrated circuits.

Figure 3:
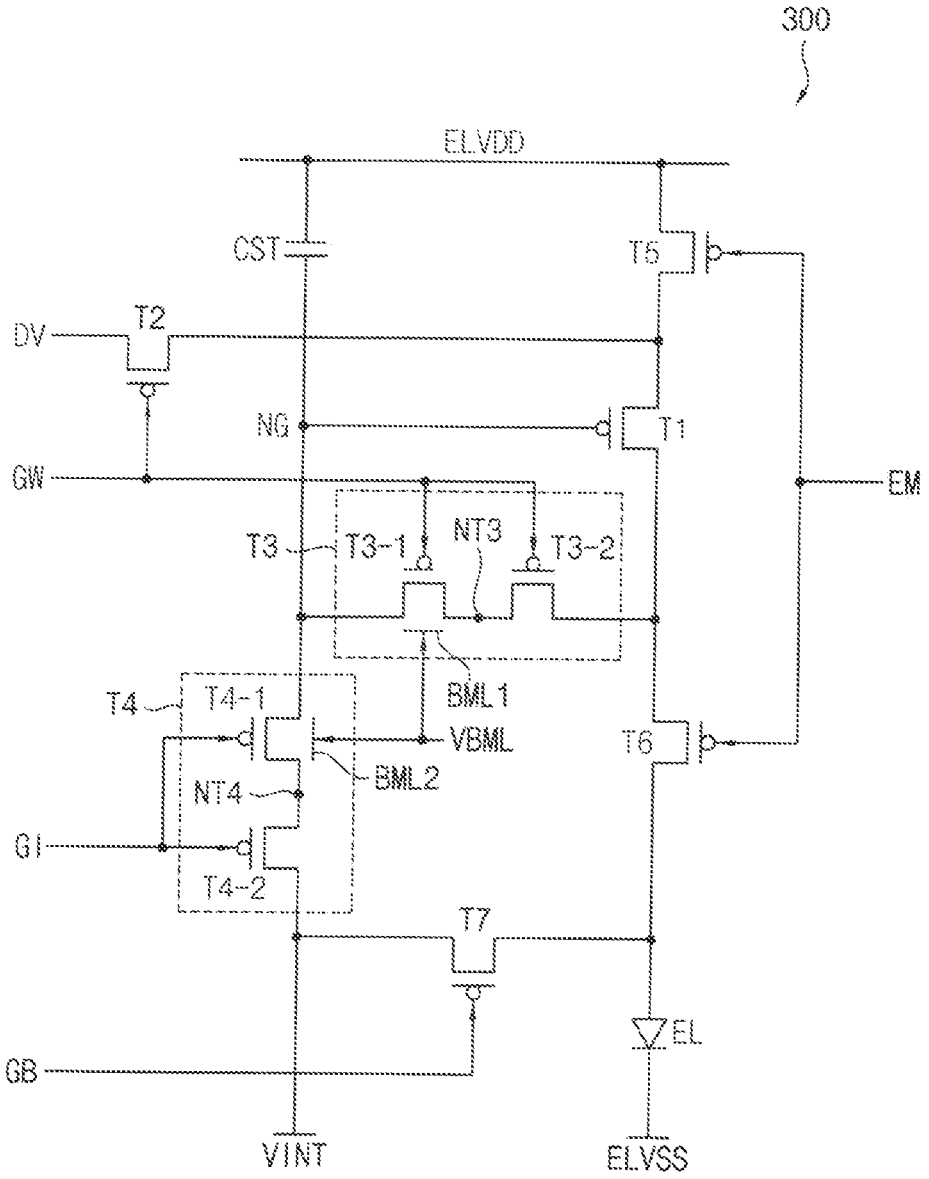
FIG. 3 is a circuit diagram illustrating a pixel of an OLED display device according to an embodiment.
Figure 5:
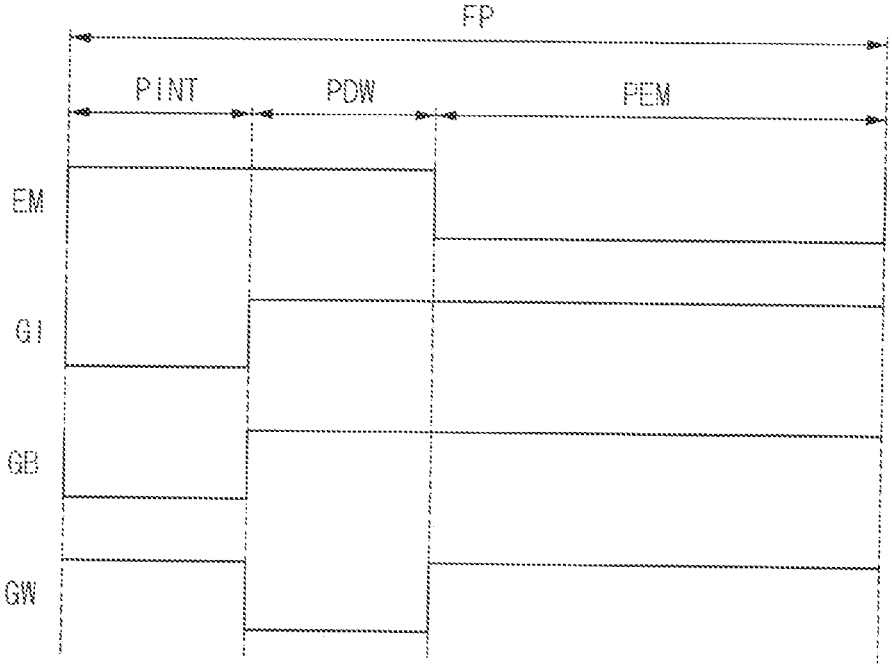
FIG. 5 is a timing diagram for describing an example of an operation of a pixel of an OLED display device according to an embodiment.
Figure 6:
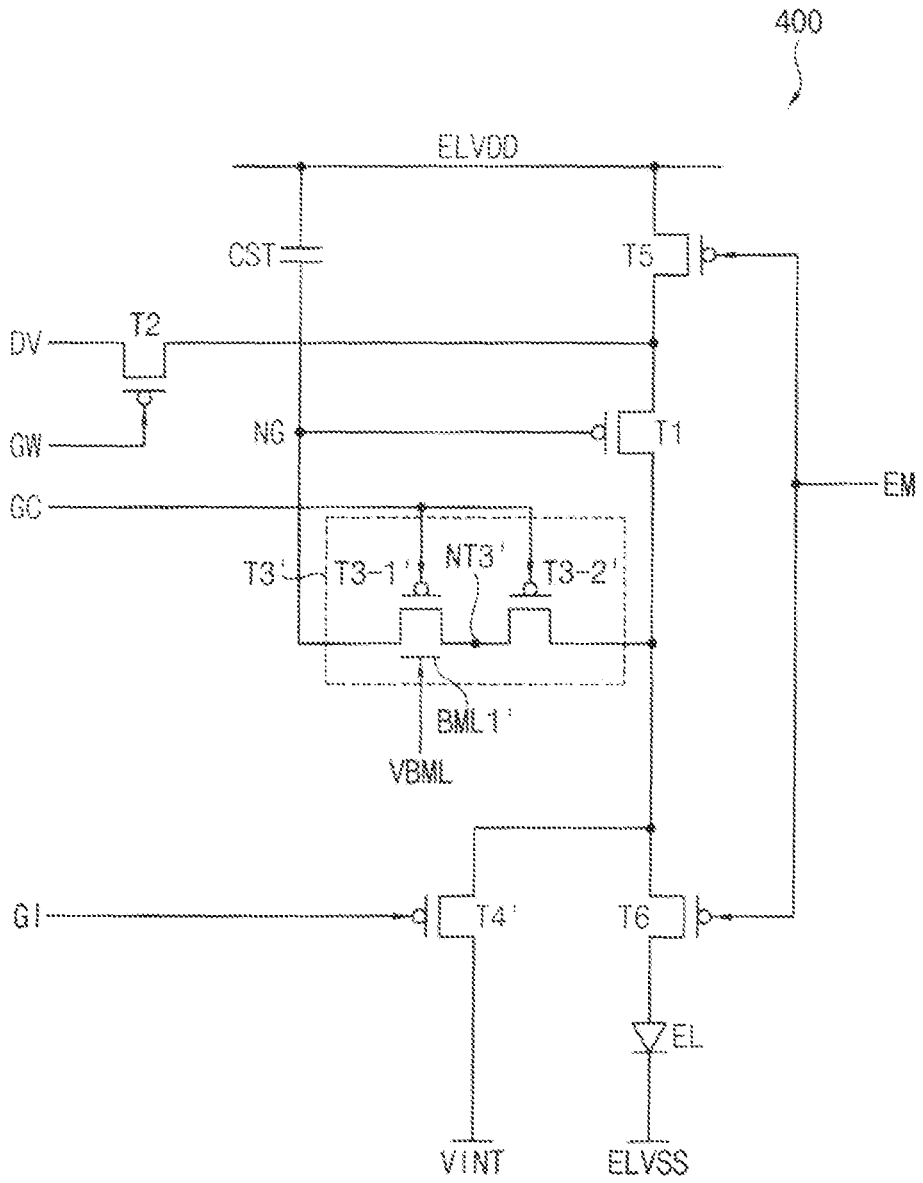
FIG. 6 is a circuit diagram illustrating a pixel of an OLED display device according to an embodiment.
Figure 7:
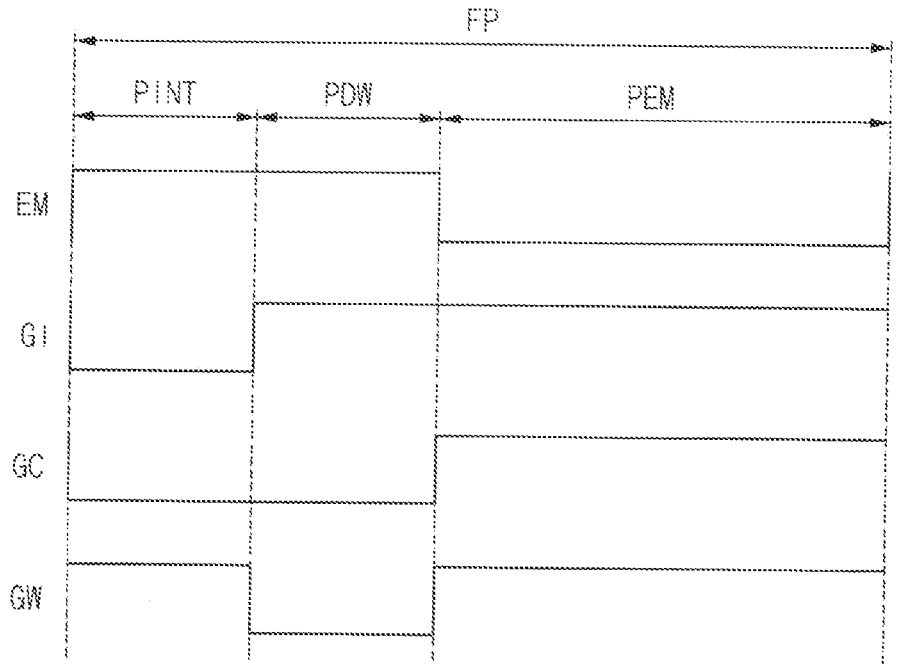
FIG. 7 is a timing diagram for describing an example of an operation of a pixel of an OLED display device according to an embodiment.
Figure 8:
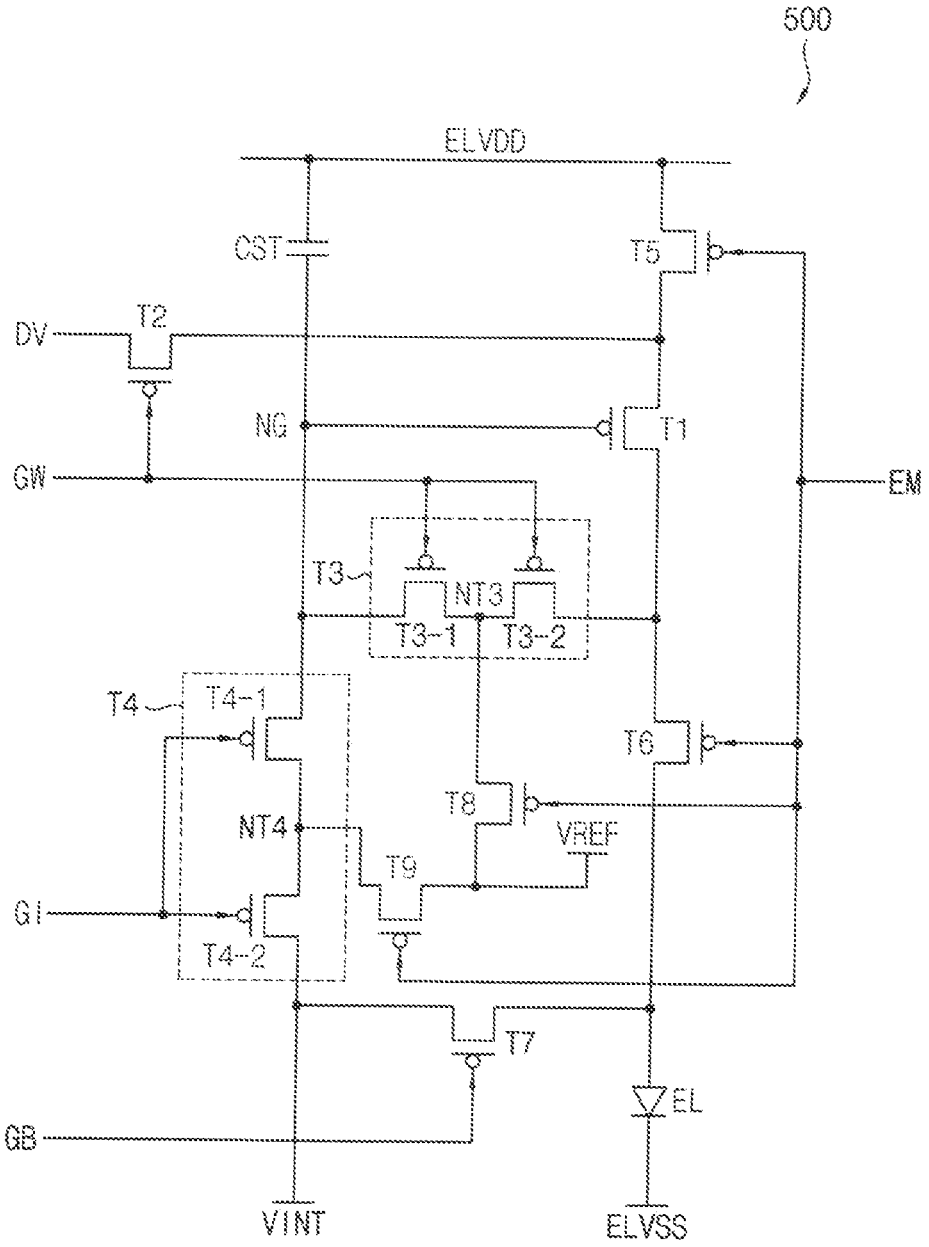
FIG. 8 is a circuit diagram illustrating a pixel of an OLED display device according to an embodiment.
Figure 9:
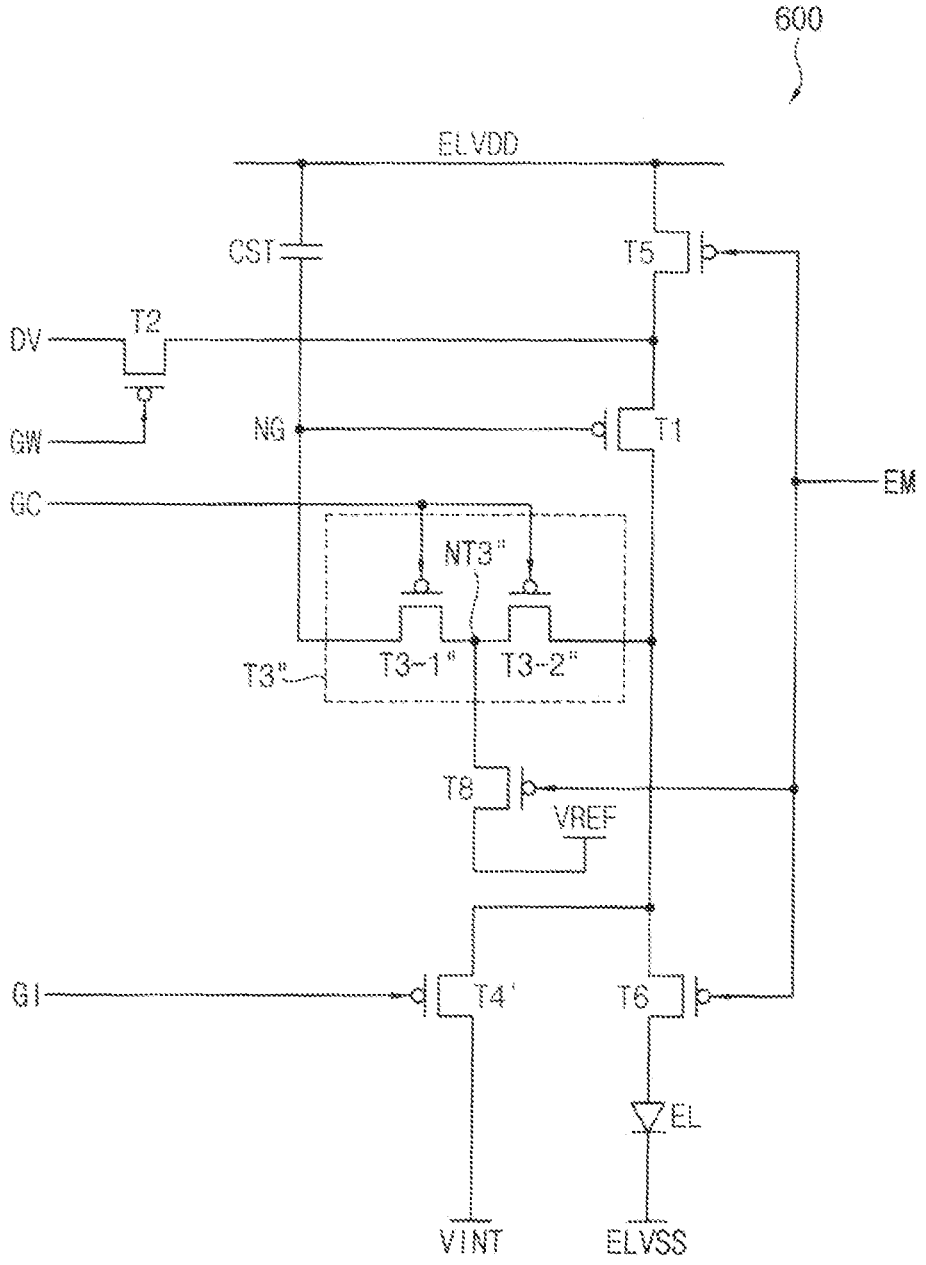
FIG. 9 is a circuit diagram illustrating a pixel of an OLED display device according to an embodiment.

The gate driver 130 may generate the gate signals GS based on a gate control signal GCTRL received from the controller 160, and may sequentially provide the gate signals GS to the plurality of pixels PX on a pixel row basis. In an embodiment, the gate control signal GCTRL may include, but is not limited to, a gate start signal and/or a gate clock signal. In an embodiment, the gate signal GS may include, but is not limited to, a gate initialization signal GI, a gate bypass signal GB and/or a gate writing signal GW as illustrated in FIGS. 3, 5 and 8, or may include, but is not limited to, the gate initialization signal GI, a gate compensation signal GC and/or the gate writing signal GW as illustrated in FIGS. 6, 7 and 9. In an embodiment, the gate driver 130 may be integrated or formed in a peripheral portion of the display panel 110. In another embodiment, the gate driver 130 may be implemented with one or more integrated circuits.

The emission driver 140 may generate the emission signals EM based on an emission control signal EMCTRL received from the controller 160, and may provide the emission signals EM to the plurality of pixels PX. In an embodiment, the emission signals EM may be sequentially provided to the plurality of pixels PX on a pixel row basis. In another embodiment, the emission signals EM may be a global signal that is substantially simultaneously provided to the plurality of pixels PX. In an embodiment, the emission driver 140 may be integrated or formed in the peripheral portion of the display panel 110. In another embodiment, the emission driver 140 may be implemented with one or more integrated circuits.

The power management circuit 150 may be controlled in response to a power control signal PCTRL received from the controller 160, and may generate a first power supply voltage ELVDD, a second power supply voltage ELVSS, an initialization voltage VINT and/or the node controlling voltage VNC provided to the display panel 110. In an embodiment, the power control signal PCTRL may include a signal representing a voltage level of the node controlling voltage VNC, and the power management circuit 150 may generate the node controlling voltage VNC having the voltage level represented by the signal. In an embodiment, the power management circuit 150 may be implemented with an integrated circuit, and the integrated circuit may be referred to as a power management integrated circuit (PMIC). In another embodiment, the power management circuit 150 may be included in the controller 160 or the data driver 120.

The controller 160 (e.g., a timing controller (TCON)) may receive input image data IDAT and a control signal CTRL from an external host (e.g., an application processor (AP), a graphics processing unit (GPU) or a graphics card). In an embodiment, the control signal CTRL may include, but is not limited to, a vertical synchronization signal, a horizontal synchronization signal, an input data enable signal, a master clock signal, or the like. The controller 160 may generate the output image data ODAT, the data control signal DCTRL, the gate control signal GCTRL the emission control signal EMCTRL and the power control signal PCTRL based on the input image data IDAT and the control signal CTRL. The controller 160 may control an operation of the data driver 120 by providing the output image data ODAT and the data control signal DCTRL to the data driver 120, may control an operation of the gate driver 130 by providing the gate control signal GCTRL to the gate driver 130, may control an operation of the emission driver 140 by providing the emission control signal EMCTRL to the emission driver 140, and may control an operation of the power management circuit 150 by providing the power control signal PCTRL to the power management circuit 150.

As described above, since the compensating transistor is implemented with the first and second compensating sub-transistors, the leakage current of the compensating transistor from the drain of the driving transistor to the gate node may be minimized. Although the compensating transistor is implemented with the first and second compensating sub-transistors, a parasitic capacitance might form between a node between the first and second compensating sub-transistors and a line of a signal (e.g., the gate writing signal GW illustrated in FIGS. 3 and 8 or the gate compensation signal GC illustrated in FIGS. 6 and 9) applied to the first and second compensating sub-transistors, and a leakage current might flow from the node between the first and second compensating sub-transistors to the gate node. To minimize or prevent the leakage current caused by the parasitic capacitance, the panel driver of the OLED display device 100 according to an embodiment may provide the node controlling voltage VNC to each pixel PX. The node controlling voltage VNC may control a voltage of the node between the first and second compensating sub-transistors to minimize the leakage current caused by the parasitic capacitance. In an embodiment, at least one of the first and second compensating sub-transistors may include a bottom electrode (or a bottom metal layer (BML)), and the node controlling voltage VNC may be a bottom electrode voltage VBML applied to the bottom electrode. In another embodiment, each pixel PX may further include a reference transistor that applies a reference voltage VREF to the node between the first and second compensating sub-transistors, and the node controlling voltage VNC may be the reference voltage VREF.

In the OLED display device 100 according to an embodiment, to minimize the leakage current, the panel driver may determine the voltage level of the node controlling voltage VNC according to the input image data IDAT. However, in a case where an image displayed by the OLED display device 100 is changed, or in a case where the input image data IDAT are changed between adjacent frame periods, the voltage level of the node controlling voltage VNC may be drastically changed, and the image quality of the OLED display device 100 may be degraded. However, in the OLED display device 100 according to an embodiment, the panel driver may calculate an average representative gray level ARG of the input image data IDAT in a plurality of frame periods, may determine the voltage level of the node controlling voltage VNC based on the average representative gray level ARG, and may provide the node controlling voltage VNC to each of the plurality of pixels PX to control the voltage of the node between the first and second compensating sub-transistors. Here, the average representative gray level ARG may be an average of a plurality of representative gray levels of the input image data IDAT in the plurality of frame periods, and may be referred to as, but is not limited to, an average on pixel ratio (OPR). In an embodiment, each of the plurality of representative gray levels may be an average gray level of gray levels represented by the input image data IDAT in a corresponding frame period of the plurality of frame periods. In another embodiment, each of the plurality of representative gray levels may be a middle gray level, a maximum gray level, a minimum gray level, or the like of the gray levels represented by the input image data IDAT in the corresponding frame period.

In an embodiment, the plurality of frame periods may include at least one previous frame period and a current frame period, and the panel driver may store a previous frame representative gray level PFRG in the at least one previous frame period, may calculate a current frame representative gray level CFRG based on the input image data IDAT in the current frame period, may calculate the average representative gray level ARG by calculating an average of the previous frame representative gray level PFRG and the current frame representative gray level CFRG, may determine the voltage level of the node controlling voltage VNC corresponding to the average representative gray level ARG, and may provide the node controlling voltage VNC having the determined voltage level to each pixel PX. Accordingly, in the case where the image displayed by the OLED display device 100 is changed, the voltage level of the node controlling voltage VNC may be gradually changed, and the image quality of the OLED display device 100 may be improved. In an embodiment, to perform these operations, the controller 160 may include a previous gray storing block 172, a current gray calculating block 174, an average gray calculating block 176 and a voltage level determining block 178.

The previous gray storing block 172 may store one or more previous frame representative gray levels PFRG in one or more previous frame periods. The frame representative gray level PFRG in each previous frame period may be a representative gray level (e.g., an average gray level, a middle gray level, a maximum gray level, a minimum gray level, or the like) of the input image data IDAT in the previous frame period.

The current gray calculating block 174 may calculate the current frame representative gray level CFRG based on the input image data IDAT in the current frame period. For example, the current gray calculating block 174 may calculate the current frame representative gray level CFRG by calculating the average gray level, the middle gray level, the maximum gray level, the minimum gray level, or the like, of the gray levels represented by the input image data IDAT in the current frame period.

The average gray calculating block 176 may calculate the average representative gray level ARG by calculating the average of the previous frame representative gray level PFRG and the current frame representative gray level CFRG. For example, the average gray calculating block 176 may calculate the average representative gray level ARG by calculating an average of four previous frame representative gray levels PFRG in four previous frame periods and the current frame representative gray level CFRG in the current frame period, or by calculating an average of five frame representative gray levels. In an embodiment, the average gray calculating block 176 may apply a relatively high weight to the current frame representative gray level CFRG, may apply a relatively low weight to the previous frame representative gray level PFRG, and may calculate the average representative gray level ARG by calculating a weighted average of the previous frame representative gray level PFRG and the current frame representative gray level CFRG.

The voltage level determining block 178 may determine the voltage level of the node controlling voltage VNC corresponding to the average representative gray level ARG. The controller 160 may generate the power control signal PCTRL representing the determined voltage level of the node controlling voltage VNC, and the power management circuit 150 may provide the node controlling voltage VNC having the determined voltage level to each pixel PX in response to the power control signal PCTRL. For example, the node controlling voltage VNC may be the bottom electrode voltage VBML, and the voltage level determining block 178 may determine the voltage level of the bottom electrode voltage VBML in a range from about −9V to about −7V, without limitation thereto. In this case, the voltage level determining block 178 may determine the voltage level of the bottom electrode voltage VBML as about −7V when the average representative gray level ARG represents a 0-gray level, and may determine the voltage level of the bottom electrode voltage VBML as about −9V when the average representative gray level ARG represents a 255-gray level. In another example, the node controlling voltage VNC may be the reference voltage VREF, and the voltage level determining block 178 may determine the voltage level of the reference voltage VREF in a range from about 0V to about 4V, without limitation thereto. In this case, the voltage level determining block 178 may determine the voltage level of the reference voltage VREF as about 4V when the average representative gray level ARG represents the 0-gray level, and may determine the voltage level of the reference voltage VREF as about 0V (or about 1V) when the average representative gray level ARG represents the 255-gray level.

FIG. 2 illustrates an example where images 200 displayed in the display panel 110 are changed from an 'A' image to a '13' image. In the example of FIG. 2, the input image data IDAT corresponding to the 'A' image may have a representative gray level RG of about 150, and the input image data IDAT corresponding to the '13' image may have a representative gray level RG of about 100. As illustrated in FIG. 2, in a third frame period FP3, the average gray calculating block 176 may calculate an average representative gray level ARG of about 150 by calculating an average of two previous frame representative gray level PFRG of about 150 and about 150 in first and second frame periods FP1 and FP2, respectively, and a current frame representative gray level CFRG of about 150 in the third frame period FP3, and the voltage level determining block 178 may determine the voltage level of the node controlling voltage VNC as a first voltage level VL1 corresponding to the average representative gray level ARG of about 150. Further, in a fifth frame period FP5, the average gray calculating block 176 may calculate an average representative gray level ARG of about 145 by calculating an average of two previous frame representative gray level PFRG of about 150 and about 150 in third and fourth frame periods FP3 and FP4, respectively, and a current frame representative gray level CFRG of about 136 in the fifth frame period FP5, and the voltage level determining block 178 may determine the voltage level of the node controlling voltage VNC as a second voltage level VL2 corresponding to the average representative gray level ARG of about 145. In this manner, the voltage level determining block 178 may determine the voltage level of the node controlling voltage VNC as a third voltage level VL3 corresponding to an average representative gray level ARG of about 128 in a sixth frame period FP6, may determine the voltage level of the node controlling voltage VNC as a fourth voltage level VL4 corresponding to an average representative gray level ARG of about 112 in a seventh frame period FP7, and may determine the voltage level of the node controlling voltage VNC as a fifth voltage level VL5 corresponding to an average representative gray level ARG of about 100 in an eighth frame period FP8. Accordingly, even if the images 200 displayed in the display panel 110 are changed from the 'A' image to the 'B' image, the voltage level of the node controlling voltage VNC may be gradually changed from the first voltage level VL1 to the fifth voltage level VL5, and thus the image quality of the OLED display device 100 may be improved.

As described above, in the OLED display device 100 according to an embodiment, each pixel PX may include the first and second compensating sub-transistors coupled in series between the gate node and the drain of the driving transistor. Further, the panel driver may determine the voltage level of the node controlling voltage VNC according to the average representative gray level ARG in the plurality of frame periods, and may provide the node controlling voltage VNC to each pixel PX to control the voltage of the node between the first and second compensating sub-transistors. Thus, the leakage current from/to the gate node may be minimized. Further, when an image displayed by the OLED display device 100 is changed, the voltage level of the node controlling voltage VNC may be gradually changed. Accordingly, the image quality of the OLED display device 100 may be improved.

Figure 4:
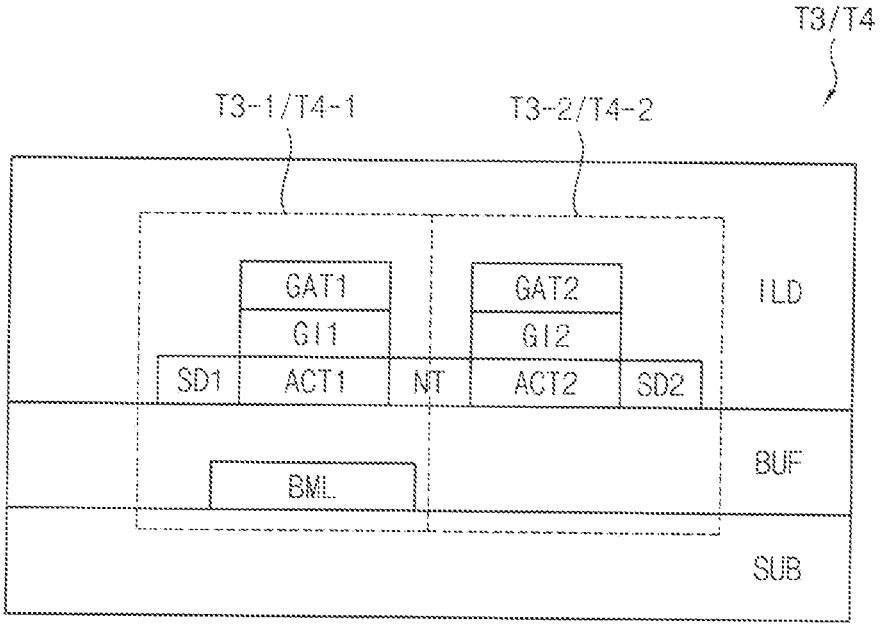
FIG. 4 is a cross-sectional diagram illustrating an example of a compensating transistor or a gate initializing transistor included in a pixel of an OLED display device according to an embodiment.

FIG. 3 illustrates a pixel circuit of an OLED display device according to an embodiment, FIG. 4 illustrates a cross-section of an example of a compensating transistor or a gate initializing transistor included in a pixel of an OLED display device according to an embodiment, and FIG. 5 illustrates signal timing for describing an example of an operation of a pixel of an OLED display device according to an embodiment.

Referring to FIG. 3, a pixel 300 of an OLED display device according to an embodiment may include a storage capacitor CST, a driving transistor T1, a switching transistor T2, a compensating transistor T3, a gate initializing transistor T4, a first emitting transistor T5, a second emitting transistor T6, an anode initializing transistor T7 and an organic light emitting diode EL.

The storage capacitor CST may store a data voltage DV transferred through the switching transistor T2 and the (diode-connected) driving transistor T1. In an embodiment, the storage capacitor CST may have a first electrode coupled to a line of a first power supply voltage ELVDD, and a second electrode coupled to a gate node NG.

The driving transistor T1 may generate a driving current based on the data voltage DV stored in the storage capacitor CST, or a voltage of the gate node NG. In an embodiment, the driving transistor T1 may have a gate electrode coupled to the second electrode of the storage capacitor CST, or the gate node NG, a source coupled to a second source/drain of the first emitting transistor T5, and a drain coupled to a first source/drain of the second emitting transistor T6.

The switching transistor T2 may transfer the data voltage DV to the source of the driving transistor T1 in response to a gate writing signal GW. The switching transistor T2 may be referred to as a scan transistor. In an embodiment, the switching transistor T2 may have a gate electrode receiving the gate writing signal GW, a first source/drain receiving the data voltage DV, and a second source/drain coupled to the source of the driving transistor T1.

Th compensating transistor T3 may diode-connect the driving transistor T1 in response to the gate writing signal GW. In an embodiment, the compensating transistor T3 may have a gate electrode receiving the gate writing signal GW, a first source/drain (or a second source/drain of a second compensating sub-transistor T3-2) coupled to the drain of the driving transistor T1, and a second source/drain (or a first source/drain of a first compensating sub-transistor T3-1) coupled to the gate electrode of the driving transistor T1, or the gate node NG. While the gate writing signal GW is applied, the data voltage DV transferred by the switching transistor T2 may be stored in the storage capacitor CST through the driving transistor T1 that is diode-connected by the compensating transistor T3. Accordingly, the storage capacitor CST may store the data voltage DV where a threshold voltage of the driving transistor T1 is compensated.

The gate initializing transistor T4 may transfer an initialization voltage VINT to the gate node NG in response to a gate initialization signal GI. In an embodiment, the gate initializing transistor T4 may include a gate electrode receiving the gate initialization signal GI, a first source/drain (or a first source/drain of a first gate initializing sub-transistor T4-1) coupled to the gate node NG, and a second source/drain (or a second source/drain of a second gate initializing sub-transistor T4-2) coupled to a line of the initialization voltage VINT. While the gate initialization signal GI is applied, the gate initializing transistor T4 may initialize the gate node NG, or the storage capacitor CST and the gate electrode of the driving transistor T1 by using the initialization voltage VINT.

The first emitting transistor T5 may couple the line of the first power supply voltage ELVDD to the source of the driving transistor T1 in response to an emission signal EM. In an embodiment, the first emitting transistor T5 may include a gate electrode receiving the emission signal EM, a first source/drain coupled to the line of the first power supply voltage ELVDD, and a second source/drain coupled to the source of the driving transistor T1.

The second emitting transistor T6 may couple the drain of the driving transistor T1 to an anode of the organic light emitting diode EL in response to the emission signal EM. In an embodiment, the second emitting transistor T6 may include a gate electrode receiving the emission signal EM, a first source/drain coupled to the drain of the driving transistor T1, and a second source/drain coupled to the anode of the organic light emitting diode EL. While the emission signal EM is applied, the first and second emitting transistors T5 and T6 may be turned on, and a path of the driving current from the line of the first power supply voltage ELVDD to a line of a second power supply voltage ELVSS may be formed.

The anode initializing transistor T7 may transfer the initialization voltage VINT to the anode of the organic light emitting diode EL in response to a gate bypass signal GB. In an embodiment, the anode initializing transistor T7 may include a gate electrode receiving the gate bypass signal GB, a first source/drain coupled to the anode of the organic light emitting diode EL, and a second source/drain coupled to the line of the initialization voltage VINT. While the gate bypass signal GB is applied, the anode initializing transistor T7 may initialize the organic light emitting diode EL by using the initialization voltage VINT.

The organic light emitting diode EL may emit light based on the driving current generated by the driving transistor T1. In an embodiment, the organic light emitting diode EL may have the anode coupled to the second source/drain of the second emitting transistor T6, and a cathode coupled to the line of the second power supply voltage ELVSS. While the emission signal EM is applied, the driving current generated by the driving transistor T1 may be provided to the organic light emitting diode EL, and the organic light emitting diode EL may emit light based on the driving current.

The pixel 300 may emit light based on the data voltage DV stored at the gate node NG by the storage capacitor CST in an emission period. However, during the emission period, leakage currents of the compensating transistor T3 and the gate initializing transistor T4 may flow to the gate node NG, and the data voltage DV stored at the gate node NG may be distorted. In an embodiment, to minimize the leakage currents, each of the compensating transistor T3 and the gate initializing transistor T4 having a source/drain directly coupled to the storage capacitor CST, or the gate node NG may be implemented with a dual transistor or a double gate transistor. For example, as illustrated in FIG. 3, the compensating transistor T3 may include first and second compensating sub-transistors T3-1 and T3-2 that are coupled in series between the gate node NG and the drain of the driving transistor T1, and the gate initializing transistor T4 may include first and second gate initializing sub-transistors T4-1 and T4-2 that are coupled in series between the gate node NG and the line of the initialization voltage VINT. In a case where the compensating transistor T3 includes the first and second compensating sub-transistors T3-1 and T3-2, the leakage current of the compensating transistor T3 between the drain of the driving transistor T1 and the gate node NG may be minimized. Further, in a case where the gate initializing transistor T4 includes the first and second gate initializing sub-transistors T4-1 and T4-2, the leakage current of the gate initializing transistor T4 between the line of the initialization voltage VINT and the gate node NG may be minimized.

However, even if the compensating transistor T3 includes the first and second compensating sub-transistors T3-1 and T3-2, a parasitic capacitance may be formed between a node NT3 between the first and second compensating sub-transistors T3-1 and T3-2 and a line (e.g., a line of the gate writing signal GW) of the pixel 300, and a leakage current of the first sub-transistor T3-1 from the node NT3 between the first and second compensating sub-transistors T3-1 and T3-2 to the gate node NG may occur. Further, even if the gate initializing transistor T4 includes the first and second gate initializing sub-transistors T4-1 and T4-2, a parasitic capacitance may be formed between a node NT4 between the first and second gate initializing sub-transistors T4-1 and T4-2 and a line (e.g., a line of the gate initialization signal GI) of the pixel 300, and a leakage current of the first gate initializing sub-transistor T4-1 from the node NT4 between the first and second gate initializing sub-transistors T4-1 and T4-2 to the gate node NG may occur. Accordingly, the voltage of the gate node NG may be increased, the driving current of the driving transistor T1 may be decreased, and thus a luminance of the organic light emitting diode EL may be decreased.

In the pixel 300 of the OLED display device according to an embodiment, to minimize a voltage distortion of the gate node NG caused by the leakage currents of the first compensating sub-transistor T3-1 and the first gate initializing sub-transistor T4-1, at least one of the first and second compensating sub-transistors T3-1 and T3-2 may include a first bottom electrode BML1, and at least one of the first and second gate initializing sub-transistors T4-1 and T4-2 may include a second bottom electrode BML2. In an embodiment, each of the first and second bottom electrodes BML1 and BML2 may be referred to as a bottom metal layer (BML). A bottom electrode voltage VBML may be applied to the first and second bottom electrodes BML1 and BML2, a voltage of the node NT3 between the first and second compensating sub-transistors T3-1 and T3-2 may be indirectly controlled by the bottom electrode voltage VBML applied to the first bottom electrode BML1, and a voltage of the node NT4 between the first and second gate initializing sub-transistors T4-1 and T4-2 may be indirectly controlled by the bottom electrode voltage VBML applied to the second bottom electrode BML2.

In an embodiment, as illustrated in FIG. 4, each of the compensating transistor T3 and the gate initializing transistor T4 may include a first source/drain SD1 of a first sub-transistor T3-1/T4-1, a first gate electrode GAT1 of the first sub-transistor T3-1/T4-1, a node NT that serves as a second source/drain of the first sub-transistor T3-1/T4-1 and a first source/drain of a second sub-transistor T3-2/T4-2, a second gate electrode GAT2 of the second sub-transistor T3-2/T4-2, a second source/drain SD2 of the second sub-transistor T3-2/T4-2, and a bottom electrode BML disposed under the first gate electrode GAT1 of the first sub-transistor T3-1/T4-1. For example, the bottom electrode BML may be formed on a substrate SUB, such as a glass substrate or a polyimide (P1) substrate, to overlap the first gate electrode GAT1. In an embodiment, the bottom electrode BML may include, but is not limited to, molybdenum (Mo). In another embodiment, the bottom electrode BML may include a low resistance opaque conductive material, such as aluminum (Al), Al alloy, tungsten (W), copper (Cu), nickel (Ni), chromium (Cr), titanium (Ti), platinum (Pt), tantalum (Ta), or the like. A buffer layer BUF for blocking an impurity of the substrate SUB may be formed on the bottom electrode BML. The first source/drain SD1, a first active region ACT1, the node NT, a second active region ACT2 and the second source/drain SD2 may be formed on the buffer layer BUF. First and second gate insulating layers GI1 and GI2 may be formed on the first and second active regions ACT1 and ACT2. The first and second gate electrodes GAT1 and GAT2 may be formed on the first and second gate insulating layers GI1 and GI2. The first gate electrode GAT1 may be formed to overlap the bottom electrode BML. An interlayer insulating layer ILD may be formed on the buffer layer BUF.

Although FIG. 3 illustrates an example of the pixel 300 having a 7T1C structure including seven transistors T1 through T7 and one capacitor CST, a structure of the pixel 300 is not limited to the example of FIG. 3. In an embodiment, as illustrated in FIG. 3, the transistors T1 through T7 of the pixel 300 may be implemented with, but is not limited to, p-type metal-oxide-semiconductor (PMOS) transistors. For example, at least one transistor (e.g., the compensating transistor T3 and/or the gate initializing transistor T4) of the pixel 300 may be implemented with, but is not limited to, an n-type metal-oxide-semiconductor (NMOS) transistor.

Hereinafter, an example of an operation of the pixel 300 according to an embodiment will be described below with reference to FIGS. 3 and 5.

Referring to FIGS. 3 and 5, a frame period FP for each pixel 300 may include an initialization period PINT, a data writing period PDW and an emission period PEM.

In the initialization period PINT, the gate initialization signal GI and the gate bypass signal GB may be applied to the pixel 300. The gate initializing transistor T4 may be turned on in response to the gate initialization signal GI, and the turned-on gate initializing transistor T4 may initialize the gate node NG, or the storage capacitor CST and the gate electrode of the driving transistor T1 by using the initialization voltage VINT. The anode initializing transistor T7 may be turned on in response to the gate bypass signal GB, and the turned-on anode initializing transistor T7 may initialize the organic light emitting diode EL by using the initialization voltage VINT.

In the data writing period PDW, the gate writing signal GW may be applied to the pixel 300. The switching transistor T2 and the compensating transistor T3 may be turned on in response to the gate writing signal GW. The turned-on switching transistor T2 may transfer the data voltage DV to the source of the driving transistor T1, and the turned-on compensating transistor T3 may diode-connect the driving transistor T1. Accordingly, the data voltage DV may be transferred to the storage capacitor CST, or the gate node NG through the switching transistor T2 and the diode-connected driving transistor T1, and the data voltage DV where the threshold voltage of the driving transistor T1 is compensated may be stored in the storage capacitor CST.

In the emission period PEM, the emission signal EM may be applied to the pixel 300. The first and second emitting transistors T5 and T6 may be turned on in response to the emission signal EM applied to their respective gate terminals. The turned-on first and second emitting transistors T5 and T6 may form a path of the driving current generated by the driving transistor T1 from the line of the first power supply voltage ELVDD to the line of the second power supply voltage ELVSS. Accordingly, the driving current generated by the driving transistor T1 based on the data voltage DV stored in the storage capacitor CST, or at the gate node NG may be provided to the organic light emitting diode EL, and the organic light emitting diode EL may emit light based on the driving current.

During the emission period PEM, the data voltage DV may be distorted by the leakage current to the storage capacitor CST, or the gate node NG. However, in the pixel 300 according to an embodiment, since the compensating transistor T3 is implemented with the first and second compensating sub-transistors T3-1 and T3-2, and the gate initializing transistor T4 is implemented with the first and second gate initializing sub-transistors T4-1 and T4-2, the leakage current to the gate node NG may be minimized. Further, in the pixel 300 according to an embodiment, since the first compensating sub-transistor T3-1 includes the first bottom electrode BML1, the first gate initializing sub-transistor T4-1 includes the second bottom electrode BML2, and the bottom electrode voltage VBML is applied to the first and second bottom electrodes BML1 and BML2, the voltage of the node NT3 between the first and second compensating sub-transistors T3-1 and T3-2 and the voltage of the node NT4 between the first and second gate initializing sub-transistors T4-1 and T4-2 may be controlled, and thus the leakage current to the gate node NG may be further minimized. Further, the bottom electrode voltage VBML applied to the first and second bottom electrodes BML1 and BML2 may have a voltage level corresponding to an average representative gray level in a plurality of frame periods. Accordingly, when an image displayed by the OLED display device is changed, the voltage level of the bottom electrode voltage VBML may be gradually changed, and thus an image quality of the OLED display device may be improved.

Although FIG. 5 illustrates an example of signals EM, GI, GB and GW applied to the pixel 300, the signals EM, GI, GB and GW applied to the pixel 300 according to an embodiment are not limited to the example of FIG. 5.

According to an embodiment, a display panel 110 has a plurality of pixels 300, and each of the plurality of pixels includes a driving transistor T1 having a gate electrode coupled to a gate node NG, and a source configured to receive a data voltage DV; a compensating transistor configured to diode-connect the driving transistor, the compensating transistor T3 including first T3-1 and second T3-2 compensating sub-transistors coupled in series between the gate node NG and a drain of the driving transistor T1; a storage capacitor CST configured to store the data voltage transferred through the diode-connected driving transistor T1; an organic light emitting diode EL configured to emit light based on a driving current generated by the driving transistor T1; and an average representative gray voltage level terminal BML1 and/or BML2 responsive to an average representative gray level of input image data in a plurality of frame periods and configured to control at least one of the first T3-1 and/or T4-1 and second T3-2 and/or T4-2 compensating sub-transistors.

In an embodiment, the average representative gray voltage level terminal BML1 and/or BML2 is configured to receive a node controlling voltage VBML based on the average representative gray level to control a voltage of a node NT3 and/or NT4 between the first and second compensating sub-transistors T3-1 and T3-2 and/or T4-1 and T4-2, respectively.

In an embodiment, each of the plurality of pixels further includes a switching transistor T2 configured to transfer the data voltage DV to the source of the driving transistor T1.

FIG. 6 illustrates a pixel circuit of an OLED display device according to an embodiment, and FIG. 7 illustrates signal timing for describing an example of an operation of a pixel of an OLED display device according to an embodiment.

Referring to FIG. 6, a pixel 400 of an OLED display device according to an embodiment may include a storage capacitor CST, a driving transistor T1, a switching transistor T2, a compensating transistor T3', a gate initializing transistor T4', a first emitting transistor T5, a second emitting transistor T6 and an organic light emitting diode EL. The pixel 400 of FIG. 6 may have a similar configuration and a similar operation to a pixel 300 of FIG. 3, except that the pixel 400 might not include an anode initializing transistor T7, the compensating transistor T3' may receive a gate compensation signal GC, a first source/drain of the gate initializing transistor T4' is coupled to a drain of the driving transistor T1 instead of a gate node NG.

The compensating transistor T3' may diode-connect the driving transistor T1 in response to the gate compensation signal GC. A gate electrode of the compensating transistor T3' may receive the gate compensation signal GC. In an embodiment, the compensating transistor T3' may include first and second compensating sub-transistors T3-1' and T3-2' that are coupled in series between the gate node NG and the drain of the driving transistor T1. Accordingly, a leakage current to the gate node NG may be minimized. Further, In an embodiment, the gate compensation signal GC applied to a gate electrode of the first compensating sub-transistor T3-1' and the gate compensation signal GC applied to a gate electrode of the second compensating sub-transistor T3-2' may have, but is not limited to, different voltage levels.

In an embodiment, at least one of the first and second compensating sub-transistors T3-1' and T3-2' may include a bottom electrode BML1'. For example, as illustrated in FIG. 6, the first compensating sub-transistor T3-1' may include the bottom electrode BML1' disposed to overlap the gate electrode of the first compensating sub-transistor T3-1'. A bottom electrode voltage VBML may be applied to the bottom electrode BML1', a voltage of a node NT3' between the first and second compensating sub-transistors T3-1' and T3-2' may be indirectly controlled by the bottom electrode voltage VBML applied to the bottom electrode, and thus the leakage current to the gate node NG may be further minimized. Further, the bottom electrode voltage VBML applied to the bottom electrode BML1' may have a voltage level corresponding to an average representative gray level in a plurality of frame periods. Accordingly, when an image displayed by the OLED display device is changed, the voltage level of the bottom electrode voltage VBML may be gradually changed, and thus an image quality of the OLED display device may be improved.

The gate initializing transistor T4' may transfer an initialization voltage VINT to the drain of the driving transistor T1 in response to a gate initialization signal GI. In an embodiment, the gate initializing transistor T4' may include a gate electrode receiving the gate initialization signal GI, a first source/drain coupled to the drain of the driving transistor T1, and a second source/drain coupled to a line of the initialization voltage VINT. In the pixel 400 of FIG. 6, since the gate initializing transistor T4' is not directly coupled to the gate node NG, or the storage capacitor CST, the gate initializing transistor T4' might not be implemented with a dual transistor. The gate initializing transistor T4' may apply the initialization voltage VINT to the gate node NG through the compensating transistor T3' to initialize the storage capacitor CST and a gate electrode of the driving transistor T1. In an embodiment, the gate initializing transistor T4' may further apply the initialization voltage VINT to the organic light emitting diode EL through the second emitting transistor T6 to initialize the organic light emitting diode EL.

Hereinafter, an example of an operation of the pixel 400 according to an embodiment will be described below with reference to FIGS. 6 and 7.

Referring to FIGS. 6 and 7, a frame period FP for each pixel 400 may include an initialization period PINT, a data writing period PDW and an emission period PEM.

In the initialization period PINT, the gate initialization signal GI and the gate compensation signal GC may be applied to the pixel 400. The compensating transistor T3' may be turned on in response to the gate compensation signal GC, and the gate initializing transistor T4' may be turned on in response to the gate initialization signal GI. The turned-on compensating transistor T3' and the turned-on gate initializing transistor T4 may initialize the gate node NG, or the storage capacitor CST and the gate electrode of the driving transistor T1 by using the initialization voltage VINT. In an embodiment, before the initialization period PINT, a black data voltage may be applied to the storage capacitor CST, and then the gate initialization signal GI and an emission signal EM may be applied to the pixel 400. While the gate initialization signal GI and the emission signal EM are applied, the gate initializing transistor T4' and the second emitting transistor T6 may be turned on, and the turned-on gate initializing transistor T4' and the turned-on second emitting transistor T6 may initialize the organic light emitting diode EL by using the initialization voltage VINT.

In the data writing period PDW, a gate writing signal GW and the gate compensation signal GC may be applied to the pixel 400. The switching transistor T2 may be turned on in response to the gate writing signal GW, and the compensating transistor T3' may be turned on in response to the gate compensation signal GC. The turned-on switching transistor T2 may transfer the data voltage DV to a source of the driving transistor T1, and the turned-on compensating transistor T3' may diode-connect the driving transistor T1. Accordingly, the data voltage DV may be transferred to the storage capacitor CST or to the gate node NG through the switching transistor T2 and the diode-connected driving transistor T1, and the data voltage DV for which a threshold voltage of the driving transistor T1 is compensated may be stored in the storage capacitor CST.

In the emission period PEM, the emission signal EM may be applied to the pixel 400. The first and second emitting transistors T5 and T6 may be turned on in response to the emission signal EM. The turned-on first and second emitting transistors T5 and T6 may form a path of a driving current generated by the driving transistor T1 from a line of a first power supply voltage ELVDD to a line of a second power supply voltage ELVSS. Accordingly, the driving current generated based on the data voltage DV stored in the storage capacitor CST, or at the gate node NG, may be provided to the organic light emitting diode EL, and the organic light emitting diode EL may emit light based on the driving current.

As described above, in the pixel 400 according to an embodiment, since the compensating transistor T3' is implemented with the first and second compensating sub-transistors T3-1' and T3-2', and thus the leakage current to the gate node NG may be minimized. Further, the first compensating sub-transistor T3-1' may include the bottom electrode BML1', the bottom electrode voltage VBML may be applied to the bottom electrode BML1', and thus the leakage current to the gate node NG may be further minimized. Further, the bottom electrode voltage VBML applied to the bottom electrode BML1' may have a voltage level corresponding to an average representative gray level in a plurality of frame periods. Accordingly, when an image displayed by the OLED display device is changed, the voltage level of the bottom electrode voltage VBML may be gradually changed, and thus an image quality of the OLED display device may be improved.

According to an embodiment, in each of the plurality of pixels 400, at least one of the first T3-1' and second T3-2' compensating sub-transistors includes a first bottom electrode BML1', and the average representative gray voltage level terminal is configured to apply a bottom electrode voltage VBML to the first bottom electrode based on the average representative gray level.

FIG. 8 illustrates a pixel circuit of an OLED display device according to an embodiment.

Referring to FIG. 8, a pixel 500 of an OLED display device according to an embodiment may include a storage capacitor CST, a driving transistor T1, a switching transistor T2, a compensating transistor T3, a gate initializing transistor T4, a first emitting transistor T5, a second emitting transistor T6, an anode initializing transistor T7, a first reference transistor T8, a second reference transistor T9 and an organic light emitting diode EL. The pixel 500 of FIG. 8 may have a similar configuration and a similar operation to a pixel 300 of FIG. 3, except that a first compensating sub-transistor T3-1 and a first gate initializing sub-transistor T4-1 might not include first and second bottom electrodes BML1 and BML2, and the pixel 500 may include the first and second reference transistors T8 and T9.

The compensating transistor T3 may include first and second compensating sub-transistors T3-1 and T3-2 that are coupled in series between a gate node NG and a drain of the driving transistor T1, and the gate initializing transistor T4 may include first and second gate initializing sub-transistors T4-1 and T4-2 that are coupled in series between the gate node NG and a line of an initialization voltage VINT. Accordingly, a leakage current to the gate node NG may be minimized.

The first reference transistor T8 may apply a reference voltage VREF to a node NT3 between the first and second compensating sub-transistors T3-1 and T3-2 in response to an emission signal EM. In an embodiment, the first reference transistor T8 may include a gate electrode receiving the emission signal EM, a first source/drain coupled to a line of the reference voltage VREF, and a second source/drain coupled to the node NT3 between the first and second compensating sub-transistors T3-1 and T3-2. The first reference transistor T8 may control a voltage of the node NT3 between the first and second compensating sub-transistors T3-1 and T3-2 by applying the reference voltage VREF to the node NT3 between the first and second compensating sub-transistors T3-1 and T3-2. Accordingly, the leakage current to the gate node NG may be further minimized.

The second reference transistor T9 may apply the reference voltage VREF to a node NT4 between the first and second gate initializing sub-transistors T4-1 and T4-2 in response to the emission signal EM. In an embodiment, the second reference transistor T9 may include a gate electrode receiving the emission signal EM, a first source/drain coupled to the line of the reference voltage VREF, and a second source/drain coupled to the node NT4 between the first and second gate initializing sub-transistors T4-1 and T4-2. The second reference transistor T9 may control a voltage of the node NT4 between the first and second gate initializing sub-transistors T4-1 and T4-2 by applying the reference voltage VREF to the node NT4 between the first and second gate initializing sub-transistors T4-1 and T4-2. Accordingly, the leakage current to the gate node NG may be further minimized.

In an embodiment, the reference voltage VREF may have a voltage level corresponding to an average representative gray level in a plurality of frame periods. Accordingly, when an image displayed by the OLED display device is changed, the voltage level of the reference voltage VREF may be gradually changed, and thus an image quality of the OLED display device may be improved.

According to an embodiment, each of the plurality of pixels 500 further includes a first reference transistor T8 configured to apply a reference voltage to a node NT3 between the first T3-1 and second T3-2 compensating sub-transistors, and a second reference transistor T9 configured to apply a reference voltage to a node NT4 between a third T4-1 and fourth T4-2 compensating sub-transistors, wherein the average representative gray voltage level terminal is configured to receive the reference voltage based on the average representative gray level.

FIG. 9 illustrates a pixel circuit of an OLED display device according to an embodiment.

Referring to FIG. 9, a pixel 600 of an OLED display device according to an embodiment may include a storage capacitor CST, a driving transistor T1, a switching transistor T2, a compensating transistor T3", a gate initializing transistor T4', a first emitting transistor T5, a second emitting transistor T6, a first reference transistor T8 and an organic light emitting diode EL. The pixel 600 of FIG. 9 may have a similar configuration and a similar operation to a pixel 500 of FIG. 8, except that the pixel 600 might not include an anode initializing transistor T7 and a second reference transistor T9, the compensating transistor T3" may receive a gate compensation signal GC, a first source/drain of the gate initializing transistor T4' is coupled to a drain of the driving transistor T1 instead of a gate node NG.

In the pixel 600 according to an embodiment, the compensating transistor T3" may include first and second compensating sub-transistors T3-1" and T3-2", and thus a leakage current to the gate node NG may be minimized. Further, the first reference transistor T8 may apply a reference voltage VREF to a node NT3" between the first and second compensating sub-transistors T3-1" and T3-2", and thus the leakage current to the gate node NG may be further minimized. Further, the reference voltage VREF may have a voltage level corresponding to an average representative gray level in a plurality of frame periods. Accordingly, when an image displayed by the OLED display device is changed, the voltage level of the reference voltage VREF may be gradually changed, and thus an image quality of the OLED display device may be improved.

According to an embodiment, each of the plurality of pixels 600 further includes a first reference transistor T8 configured to apply a reference voltage to a node NT3" between the first T3-1" and second T3-2" compensating sub-transistors, wherein the average representative gray voltage level terminal is configured to receive the reference voltage based on the average representative gray level.

Figure 10:
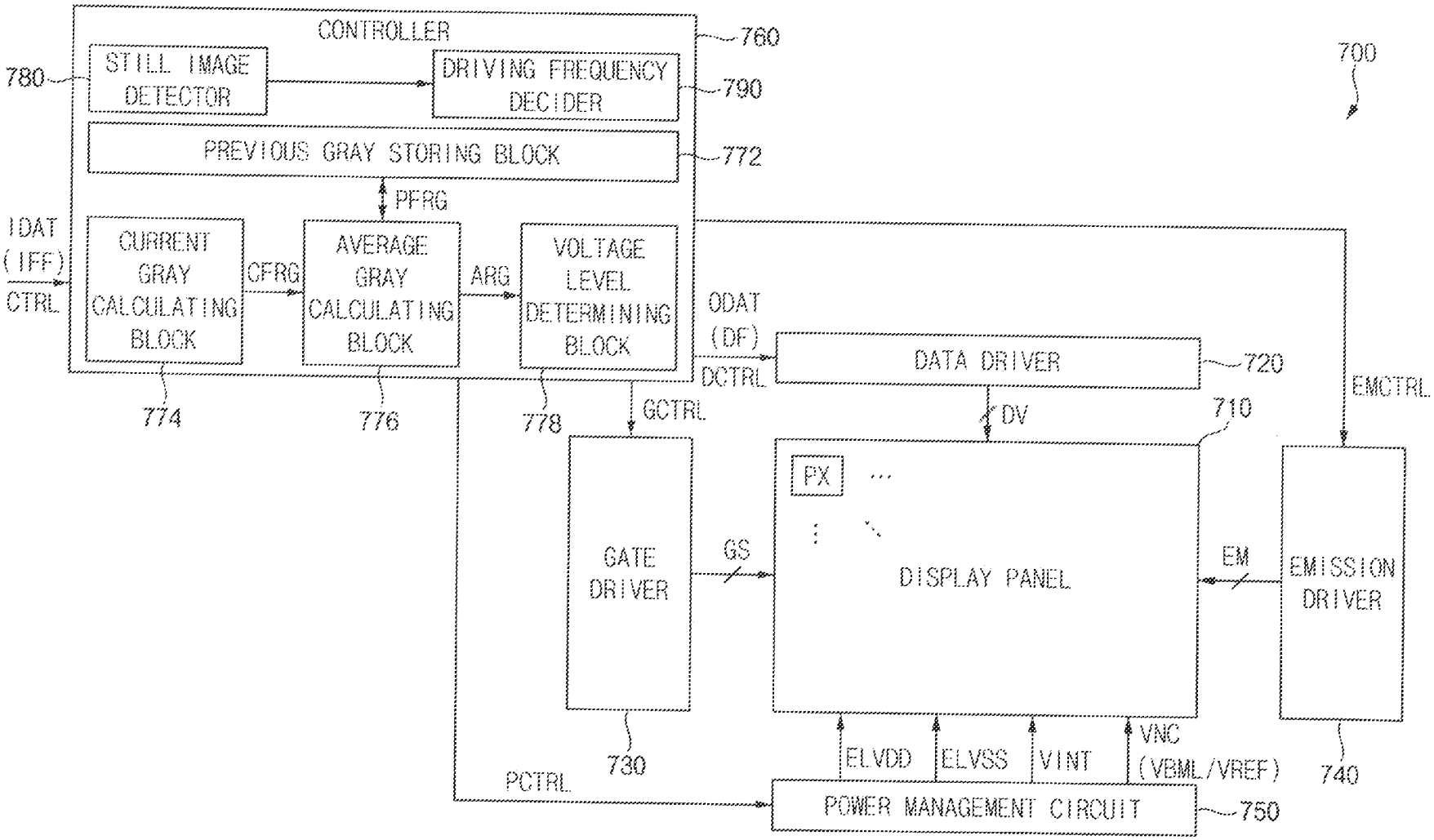
FIG. 10 is a block diagram illustrating an OLED display device according to an embodiment.
Figure 11:
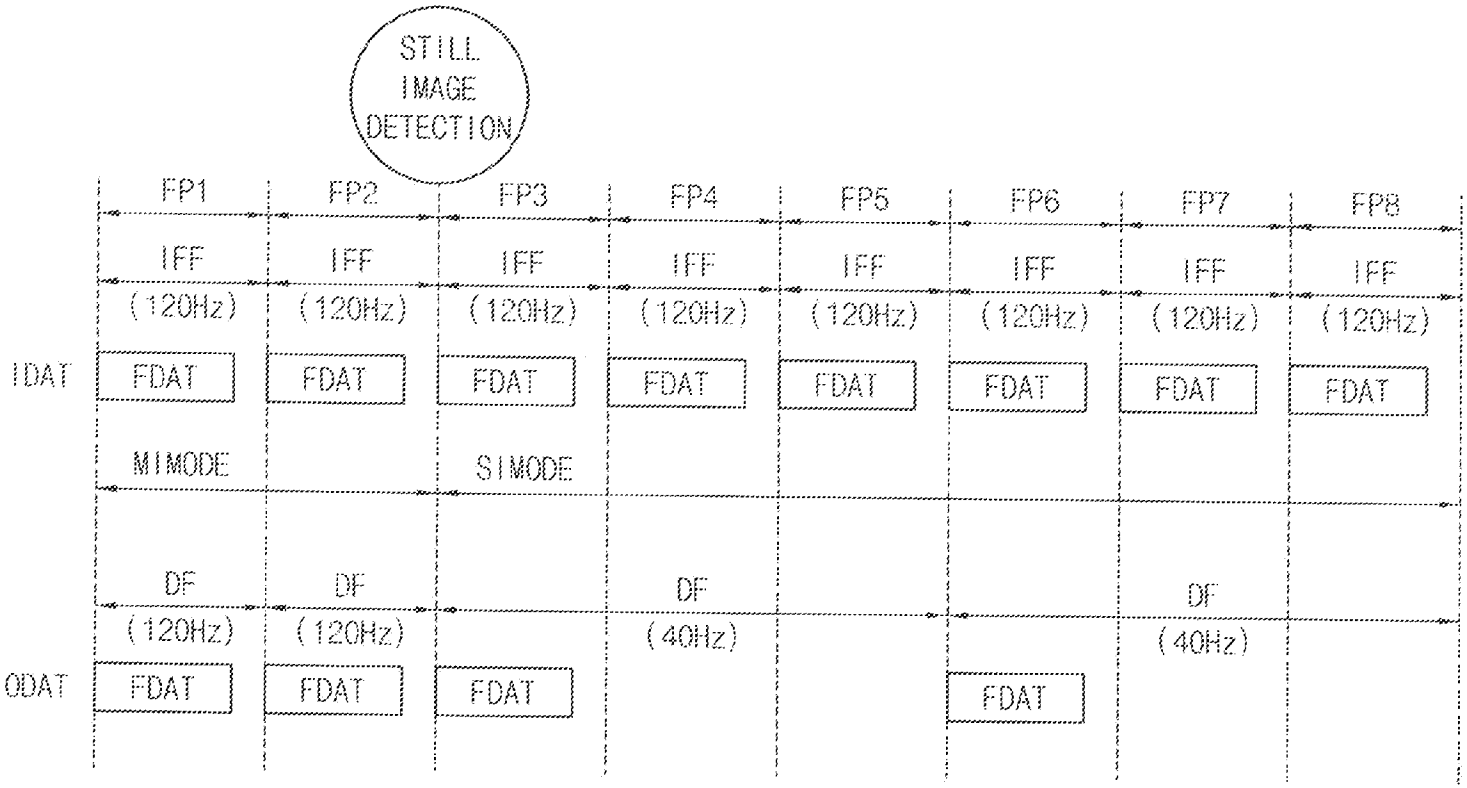
FIG. 11 is a timing diagram for describing an example of an operation of an OLED display device according to an embodiment.
Figure 12:
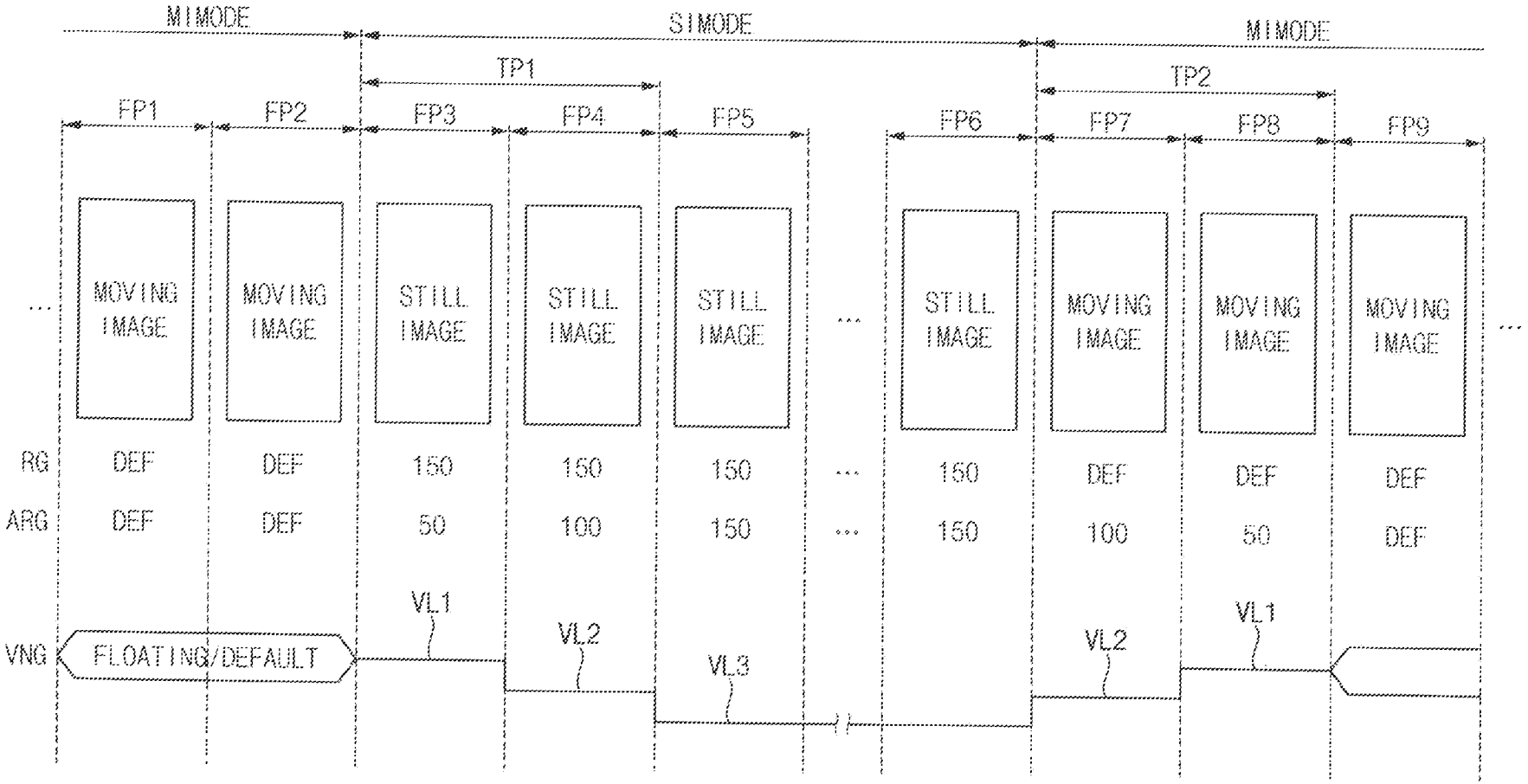
FIG. 12 is a timing diagram for describing an example where an average representative gray level is calculated, and a voltage level of a node controlling voltage is determined according to the average representative gray level in an OLED display device according to an embodiment.

FIG. 10 illustrates an OLED display device according to an embodiment, FIG. 11 illustrates signal timing for describing an example of an operation of an OLED display device according to an embodiment, and FIG. 12 illustrates signal timing for describing an example where an average representative gray level is calculated, and a voltage level of a node controlling voltage is determined according to the average representative gray level in an OLED display device according to an embodiment.

Referring to FIG. 10, an OLED display device 700 according to an embodiment may include a display panel 710 including a plurality of pixels PX, and a panel driver that drives the display panel 710. In an embodiment, the panel driver may include a data driver 720, a gate driver 730, an emission driver 740, a power management circuit 750 and a controller 760. The controller 760 may include a previous gray storing block 772, a current gray calculating block 774, an average gray calculating block 776, a voltage level determining block 778, a still image detector 780 and a driving frequency decider 790. The OLED display device 700 of FIG. 10 may have a similar configuration and a similar operation to an OLED display device 100 of FIG. 1, except that the panel driver or the controller 760 may further include the still image detector 780 and the driving frequency decider 790, a node controlling voltage VNC may be selectively applied according to a driving mode for the display panel 710 is a moving image mode or a still image mode.

The still image detector 780 may determine whether input image data IDAT represent a moving image or a still image, may determine the driving mode for the display panel 710 as the moving image mode when the input image data IDAT represent the moving image, and may determine the driving mode for the display panel 710 as the still image mode when the input image data IDAT represent the still image. In an embodiment, the still image detector 780 may determine whether the input image data IDAT represent the moving image or the still image by comparing the input image data IDAT in a previous frame period and the input image data IDAT in a current frame period.

The driving frequency decider 790 may determine a driving frequency DF for the display panel 710 as a normal driving frequency in the moving image mode, and may determine the driving frequency DF for the display panel 710 as a low frequency lower than the normal driving frequency in the still image mode. In an embodiment, in the still image mode, the driving frequency decider 790 may determine a flicker value (e.g., representing a degree of a flicker perceived by a user) corresponding to a gray level (or a luminance) of the input image data IDAT by using a flicker lookup table that stores flicker values corresponding to a plurality of gray levels, and may determine the driving frequency DF for the display panel 710 according to the flicker value. According to an embodiment, determining the flicker value may be performed on a pixel basis, on a segment basis, or a partial panel region basis.

Thus, in the still image mode, although the controller 760 may receive the input image data IDAT at a fixed input frame frequency IFF (e.g., about 120 Hz), the controller 760 may provide output image data ODAT to the data driver 720 at the driving frequency DF in a wide driving frequency range (e.g., from about 1 Hz to about 120 Hz). For example, as illustrated in FIG. 11, in first and second frame periods FP1 and FP2 in which the input image data IDAT represent the moving image, the controller 760 may receive frame data FDAT as the input image data IDAT at the input frame frequency IFF of about 120 Hz, may determine the driving mode for the display panel 710 as the moving image mode MIMODE, and may provide the frame data FDAT as the output image data ODAT to the data driver 720 at a driving frequency DF of about 120 Hz substantially the same as the input frame frequency IFF of about 120 Hz. Accordingly, the display panel 710 may be driven at the driving frequency DF of about 120 Hz. If the still image is detected, the controller 760 may determine the driving mode for the display panel 710 as the still image mode SIMODE, and may determine the driving frequency DF for the display panel 710 as a low frequency, for example about 40 Hz lower than the input frame frequency IFF of about 120 Hz. For example, in the still image mode SIMODE, the controller 760 may provide the frame data FDAT to the data driver 720 in third and sixth frame periods FP3 and FP6, and might not provide the frame data FDAT to the data driver 720 in fourth, fifth, seventh and eighth frame periods FP4, FP5, FP7 and FP8. Accordingly, in the third through eighth frame periods FP3 through FP8, the controller 760 may provide the frame data FDAT to the data driver 720 at the driving frequency DF of about 40 Hz that is one-third of the input frame frequency IFF of about 120 Hz, and the data driver 720 may drive the display panel 710 at the driving frequency DF of about 40 Hz. Although FIG. 11 illustrates an example where the display panel 710 is driven at the driving frequency DF of about 120 Hz or the driving frequency DF of about 40 Hz, In an embodiment, the display panel 710 may be driven at the driving frequency DF in the wide driving frequency range from about 1 Hz to about 120 Hz.

Further, although FIG. 11 illustrates an example where the controller 760 receives the input image data IDAT at the fixed input frame frequency IFF of about 120 Hz, In another embodiment, the controller 760 may receive the input image data IDAT at a variable input frame frequency IFF, for example, from about 1 Hz to about 120 Hz. In this case, the controller 760 may drive the display panel 710 at a variable driving frequency DF corresponding to the variable input frame frequency IFF.

In an embodiment, the panel driver may provide the node controlling voltage VNC to each pixel PX in the still image mode SIMODE, and might not provide the node controlling voltage VNC to each pixel PX in the moving image mode MIMODE. Here, not providing the node controlling voltage VNC to each pixel PX may include floating a line of the node controlling voltage VNC by the power management circuit 750, or providing a default voltage (e.g., a ground voltage) as the node controlling voltage VNC by the power management circuit 750. Since the display panel 710 is driven at the normal driving frequency in the moving image mode MIMODE, and is driven at the low frequency lower than the normal driving frequency in the still image mode SIMODE, a time in which a data voltage DV is maintained at the gate node of each pixel PX in the still image mode SIMODE may be longer than a time in which the data voltage DV is maintained at the gate node of each pixel PX in the moving image mode MIMODE. Thus, a distortion of the data voltage DV in the still image mode SIMODE may be greater than a distortion of the data voltage DV in the moving image mode MIMODE. Accordingly, the panel driver might not provide the node controlling voltage VNC to each pixel PX in the moving image mode MIMODE, but may provide the node controlling voltage VNC to each pixel PX to minimize or prevent the distortion of the data voltage DV in the still image mode SIMODE.

In a case where the node controlling voltage VNC is provided to each pixel PX in the still image mode SIMODE, and is not provided to each pixel PX in the moving image mode MIMODE, in a transition period between the still image mode SIMODE and the moving image mode MIMODE, a luminance change by the node controlling voltage VNC may be perceived by a user, and an image quality of the OLED display device 700 may be degraded. To prevent the degradation of the image quality, In an embodiment, the panel driver may provide the node controlling voltage VNC to each pixel PX in the still image mode SIMODE and in the transition period between the still image mode SIMODE and the moving image mode MIMODE, and might not provide the node controlling voltage VNC to each pixel PX in the moving image mode MIMODE after the transition period.

For example, as illustrated in FIG. 12, in first and second frame periods FP1 and FP2 in which the input image data IDAT represent the moving image, the panel driver may determine the driving mode for the display panel 710 as the moving image mode MIMODE. In the moving image mode MIMODE, the panel driver might not calculate a representative gray level RG and an average representative gray level ARG in each frame period FP1 and FP2, and may regard the representative gray level RG and the average representative gray level ARG as a default gray level DEF (e.g., a 0-gray level). Further, in the moving image mode MIMODE, the panel driver might not provide the node controlling voltage VNC to the plurality of pixels PX. For example, the panel driver may float the line of the node controlling voltage VNC, or may provide the default voltage (e.g., the ground voltage) as the node controlling voltage VNC.

Thereafter, in third through sixth frame periods FP3 through FP6 in which the input image data IDAT represent the still image, the panel driver may determine the driving mode for the display panel 710 as the still image mode SIMODE. In the still image mode SIMODE, the panel driver may calculate the representative gray level RG and the average representative gray level ARG in each frame period FP3 through FP8, and may determine a voltage level of the node controlling voltage VNC corresponding to the average representative gray level ARG. Further, in a transition period TP1 in which the driving mode is changed from the moving image mode MIMODE to the still image mode SIMODE, or in third and fourth frame periods FP3 and FP4, the panel driver may determine the average representative gray level ARG by calculating an average of the representative gray level RG, or the default gray level DEF, in at least one frame period (e.g., FP2 and/or FP1) in the moving image mode MIMODE and the representative gray level RG in at least one frame period (e.g., FP3 and/or FP4) in the still image mode SIMODE, and may determine the voltage level of the node controlling voltage VNC corresponding to the average representative gray level ARG. Accordingly, in the transition period TP1 in which the driving mode is changed from the moving image mode MIMODE to the still image mode SIMODE and in a frame period FP5 directly after the transition period TP1, the voltage level of the node controlling voltage VNC may be sequentially or gradually changed from a first voltage level VL1, to a second voltage level VL2, and to a third voltage level VL3. Thereafter, in a case where the representative gray level RG of the input image data IDAT is substantially constant in the still image mode SIMODE, the voltage level of the node controlling voltage VNC may be maintained as the third voltage level VL3.

Thereafter, in seventh through ninth frame periods FP7 through FP9 in which the input image data IDAT represent the moving image, the panel driver may determine the driving mode for the display panel 710 as the moving image mode MIMODE. In the moving image mode MIMODE, the panel driver might not calculate the representative gray level RG and the average representative gray level ARG in each frame period FP7, FP8 and FP9, and may regard the representative gray level RG and the average representative gray level ARG as the default gray level DEF (e.g., the 0-gray level). However, in a transition period TP2 in which the driving mode is changed from the still image mode SIMODE to the moving image mode MIMODE, or in the seventh and eighth frame periods FP7 and FP8, the panel driver may determine the average representative gray level ARG by calculating an average of the representative gray level RG in at least one frame period (e.g., FP6) in the still image mode SIMODE and the default gray level DEF in the moving image mode MIMODE, and may determine the voltage level of the node controlling voltage VNC corresponding to the average representative gray level ARG. Accordingly, in a frame period FP6 directly before the transition period TP2 and in the transition period TP2 in which the driving mode is changed from the still image mode SIMODE to the moving image mode MIMODE, the voltage level of the node controlling voltage VNC may be sequentially or gradually changed from the third voltage level VL3, to the second voltage level VL2, and to the first voltage level VL1. Accordingly, the luminance change by the node controlling voltage VNC might not be perceived by the user, and the image quality of the OLED display device 700 may be further improved. Thereafter, in the moving image mode MIMODE after the transition period TP2, or in the ninth frame period FP9, the panel driver may float the line of the node controlling voltage VNC, or may provide the default voltage (e.g., the ground voltage) as the node controlling voltage VNC.

Figure 13:
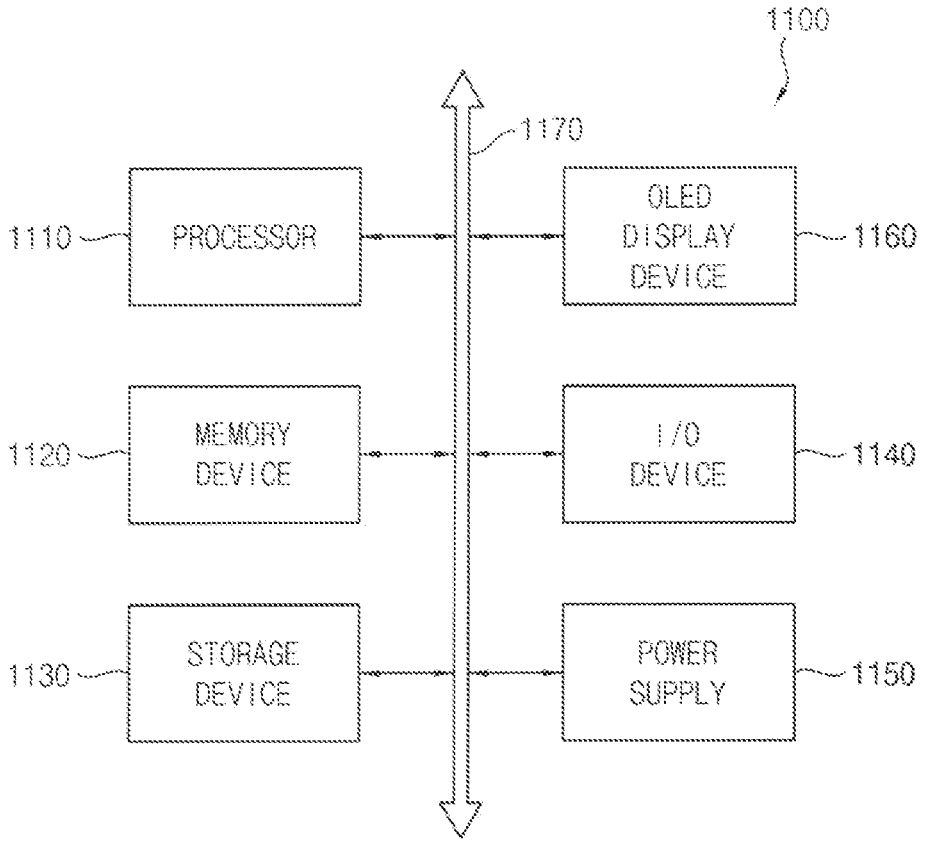
FIG. 13 is block diagram illustrating an electronic device including an OLED display device according to an embodiment.

FIG. 13 illustrates an electronic device including an OLED display device according to an embodiment.

Referring to FIG. 13, an electronic device 1100 may include a processor 1110, a memory device 1120, a storage device 1130, an input/output (I/O) device 1140, a power supply 1150, an OLED display device 1160, and at least one communications channel or bus 1170. The electronic device 1100 may further include a plurality of ports for communicating a video card, a sound card, a memory card, a universal serial bus (USB) device, other electric devices, or the like, through the at least one communications channel or bus 1170.

The processor 1110 may perform various computing functions or tasks. The processor 1110 may be an application processor (AP), a microprocessor, a central processing unit (CPU), or the like. The processor 1110 may be coupled to other components via an address bus, a control bus, a data bus, or the like, comprised by the at least one communications channel or bus 1170. Further, In an embodiment, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like, and/or at least one volatile memory device such as a dynamic random access memory (DRAM) device, a static random access memory (SRAM) device, a mobile dynamic random access memory (mobile DRAM) device, or the like.

The storage device 1130 may be a solid-state drive (SSD) device, a hard disk drive (HDD) device, a CD-ROM device, or the like. The I/O device 1140 may be an input device such as a keyboard, a keypad, a mouse, a touch screen, or the like, and an output device such as a printer, a speaker, or the like. The power supply 1150 may supply power for operations of the electronic device 1100. The OLED display device 1160 may be coupled to other components through the buses or other communication links.

In the OLED display device 1160, each pixel may include first and second compensating sub-transistors coupled in series between a gate node and a drain of a driving transistor. Further, a panel driver of the OLED display device 1160 may determine a voltage level of a node controlling voltage according to an average representative gray level in a plurality of frame periods, and may provide the node controlling voltage to each pixel to control a voltage of a node between the first and second compensating sub-transistors. Thus, a leakage current from/to the gate node may be minimized. Further, when an image displayed by the OLED display device 1160 is changed, the voltage level of the node controlling voltage may be gradually changed. Accordingly, an image quality of the OLED display device 1160 may be improved.

The inventive concepts may be applied to any OLED display device 1160, and any electronic device 1100 including the OLED display device 1160. For example, the inventive concepts may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, or the like.

The foregoing is illustrative of the inventive concept and is not to be construed as limiting thereof. Although illustrative embodiments have been described, those of ordinary skill in the pertinent art will readily appreciate that many modifications are possible without materially departing from the teachings of the present disclosure. Accordingly, all such modifications are intended to be included within the scope of the inventive concept as defined in the claims. Therefore, it is to be understood that the foregoing is illustrative of various embodiments and is not to be construed as limited to the specific embodiments disclosed, and that modifications to the disclosed as well as other embodiments are intended to be included within the scope of the appended claims.

What is claimed is:

1. An organic light emitting diode (OLED) display device comprising:

a display panel including a plurality of pixels; and a panel driver configured to drive the display panel, wherein each of the plurality of pixels comprises:

a driving transistor having a gate electrode coupled to a gate node, and a source configured to receive a data voltage;

a compensating transistor configured to diode-connect the driving transistor, the compensating transistor including first and second compensating sub-transistors coupled in series between the gate node and a drain of the driving transistor;

a first node disposed between the first and second compensating sub-transistors;

a first reference transistor configured to apply a reference voltage to the first node;

a storage capacitor configured to store the data voltage transferred through the diode-connected driving transistor;

and an organic light emitting diode configured to emit light based on a driving current generated by the driving transistor, and wherein the panel driver calculates an average representative gray level of input image data in a plurality of frame periods, determines a voltage level of a node controlling voltage for the first node based on the average representative gray level, and provides the node controlling voltage to each of the plurality of pixels.

2. The OLED display device of claim 1, wherein the average representative gray level is an average of a plurality of representative gray levels of the input image data in the plurality of frame periods, and wherein each of the plurality of representative gray levels is an average gray level, a middle gray level, a maximum gray level or a minimum gray level of gray levels represented by the input image data in a corresponding frame period of the plurality of frame periods.

3. The OLED display device of claim 1, wherein the panel driver comprises:

a data driver configured to provide the data voltage to each of the plurality of pixels;

a gate driver configured to provide a gate signal to each of the plurality of pixels;

a power management circuit configured to provide the node controlling voltage to each of the plurality of pixels; and a controller configured to control the data driver, the gate driver and the power management circuit, the controller comprising:

a previous gray storing block configured to store a previous frame representative gray level in at least one previous frame period;

a current gray calculating block configured to calculate a current frame representative gray level based on the input image data in a current frame period;

an average gray calculating block configured to calculate the average representative gray level by calculating an average of the previous frame representative gray level and the current frame representative gray level; and a voltage level determining block configured to determine the voltage level of the node controlling voltage corresponding to the average representative gray level.

4. The OLED display device of claim 1, wherein at least one of the first and second compensating sub-transistors includes a bottom electrode, wherein the node controlling voltage is a bottom electrode voltage applied to the bottom electrode, and wherein the panel driver provides the bottom electrode voltage to each of the plurality of pixels to control a voltage of the first node between the first and second compensating sub-transistors.

5. The OLED display device of claim 1, wherein each of the plurality of pixels further comprises:

a switching transistor configured to transfer the data voltage to the source of the driving transistor;

a gate initializing transistor configured to apply an initialization voltage to the gate node in response to a gate initialization signal, the gate initializing transistor including first and second gate initializing sub-transistors coupled in series between the gate node and a line of the initialization voltage;

a first emitting transistor configured to couple a line of a power supply voltage and the source of the driving transistor in response to an emission signal;

a second emitting transistor configured to couple the drain of the driving transistor and the organic light emitting diode in response to the emission signal; and an anode initializing transistor configured to apply the initialization voltage to the organic light emitting diode in response to a gate bypass signal, wherein at least one of the first and second compensating sub-transistors includes a first bottom electrode, wherein at least one of the first and second gate initializing sub-transistors includes a second bottom electrode, and wherein the node controlling voltage is a bottom electrode voltage applied to the first and second bottom electrodes.

6. The OLED display device of claim 1, wherein each of the plurality of pixels further comprises:

a switching transistor configured to transfer the data voltage to the source of the driving transistor;

a gate initializing transistor configured to apply an initialization voltage to the drain of the driving transistor in response to a gate initialization signal;

a first emitting transistor configured to couple a line of a power supply voltage and the source of the driving transistor in response to an emission signal; and a second emitting transistor configured to couple the drain of the driving transistor and the organic light emitting diode in response to the emission signal, wherein at least one of the first and second compensating sub-transistors includes a bottom electrode, and wherein the node controlling voltage is a bottom electrode voltage applied to the bottom electrode.

7. The OLED display device of claim 1, wherein each of the plurality of pixels further comprises the first reference transistor configured to apply the reference voltage to the first node between the first and second compensating sub-transistors, wherein the node controlling voltage is the reference voltage, and wherein the panel driver provides the reference voltage to each of the plurality of pixels to control a voltage of the first node between the first and second compensating sub-transistors.

8. The OLED display device of claim 1, wherein each of the plurality of pixels further comprises:

a switching transistor configured to transfer the data voltage to the source of the driving transistor;

a gate initializing transistor configured to apply an initialization voltage to the gate node in response to a gate initialization signal, the gate initializing transistor including first and second gate initializing sub-transistors coupled in series between the gate node and a line of the initialization voltage;

a first emitting transistor configured to couple a line of a power supply voltage and the source of the driving transistor in response to an emission signal;

a second emitting transistor configured to couple the drain of the driving transistor and the organic light emitting diode in response to the emission signal;

an anode initializing transistor configured to apply the initialization voltage to the organic light emitting diode in response to a gate bypass signal;

the first reference transistor configured to apply the reference voltage to the first node between the first and second compensating sub-transistors; and a second reference transistor configured to apply the reference voltage to a node between the first and second gate initializing sub-transistors, and wherein the node controlling voltage is the reference voltage.

9. The OLED display device of claim 1, wherein each of the plurality of pixels further comprises:

a switching transistor configured to transfer the data voltage to the source of the driving transistor;

a gate initializing transistor configured to apply an initialization voltage to the drain of the driving transistor in response to a gate initialization signal;

a first emitting transistor configured to couple a line of a power supply voltage and the source of the driving transistor in response to an emission signal;

a second emitting transistor configured to couple the drain of the driving transistor and the organic light emitting diode in response to the emission signal; and the first reference transistor configured to apply the reference voltage to the first node between the first and second compensating sub-transistors, wherein the node controlling voltage is the reference voltage.

10. The OLED display device of claim 1, wherein the panel driver comprises:

a still image detector configured to determine whether the input image data represent a moving image or a still image, to determine a driving mode for the display panel as a moving image mode when the input image data represent the moving image, and to determine the driving mode for the display panel as a still image mode when the input image data represent the still image; and a driving frequency decider configured to determine a driving frequency for the display panel as a normal driving frequency in the moving image mode, and to determine the driving frequency for the display panel as a low frequency lower than the normal driving frequency in the still image mode.

11. The OLED display device of claim 10, wherein the panel driver is configured:

to provide the node controlling voltage to each of the plurality of pixels in the still image mode; and not to provide the node controlling voltage to each of the plurality of pixels in the moving image mode.

12. The OLED display device of claim 10, wherein the panel driver is configured:

to provide the node controlling voltage to each of the plurality of pixels in the still image mode and in a transition period between the still image mode and the moving image mode; and not to provide the node controlling voltage to each of the plurality of pixels in the moving image mode after the transition period.

13. An organic light emitting diode (OLED) display device comprising:

a display panel including a plurality of pixels; and a panel driver configured to drive the display panel, wherein each of the plurality of pixels comprises:

a driving transistor having a gate electrode coupled to a gate node, and a source configured to receive a data voltage;

a compensating transistor configured to diode-connect the driving transistor, the compensating transistor including first and second compensating sub-transistors coupled in series between the gate node and a drain of the driving transistor;

a storage capacitor configured to store the data voltage transferred through the switching transistor and the diode-connected driving transistor;

an organic light emitting diode configured to emit light based on a driving current generated by the driving transistor; and a first reference transistor configured to apply a reference voltage to a node between the first and second compensating sub-transistors, and wherein the panel driver calculates an average representative gray level of input image data in a plurality of frame periods, determines a voltage level of the reference voltage based on the average representative gray level, and provides the reference voltage to each of the plurality of pixels.

14. The OLED display device of claim 13, wherein each of the plurality of pixels further comprises:

a gate initializing transistor configured to apply an initialization voltage to the gate node in response to a gate initialization signal, the gate initializing transistor including first and second gate initializing sub-transistors coupled in series between the gate node and a line of the initialization voltage;

a first emitting transistor configured to couple a line of a power supply voltage and the source of the driving transistor in response to an emission signal;

a second emitting transistor configured to couple the drain of the driving transistor and the organic light emitting diode in response to the emission signal;

an anode initializing transistor configured to apply the initialization voltage to the organic light emitting diode in response to a gate bypass signal; and a second reference transistor configured to apply the reference voltage to a node between the first and second gate initializing sub-transistors.

15. The OLED display device of claim 13, wherein each of the plurality of pixels further comprises:

a gate initializing transistor configured to apply an initialization voltage to the drain of the driving transistor in response to a gate initialization signal;

a first emitting transistor configured to couple a line of a power supply voltage and the source of the driving transistor in response to an emission signal;

a second emitting transistor configured to couple the drain of the driving transistor and the organic light emitting diode in response to the emission signal; and a switching transistor configured to transfer the data voltage to the source of the driving transistor.

16. A display panel including a plurality of pixels, each of the plurality of pixels comprising:

a driving transistor having a gate electrode coupled to a gate node, and a source configured to receive a data voltage;

a compensating transistor configured to diode-connect the driving transistor, the compensating transistor including first and second compensating sub-transistors coupled in series between the gate node and a drain of the driving transistor;

a storage capacitor configured to store the data voltage transferred through the diode-connected driving transistor;

an organic light emitting diode configured to emit light based on a driving current generated by the driving transistor; and an average representative gray voltage level terminal responsive to an average representative gray level of input image data in a plurality of frame periods and configured to control at least one of the first and second compensating sub-transistors.

17. The display panel of claim 16, wherein the average representative gray voltage level terminal is configured to receive a node controlling voltage based on the average representative gray level to control a voltage of a node between the first and second compensating sub-transistors.

18. The display panel of claim 16, wherein at least one of the first and second compensating sub-transistors includes a first bottom electrode, and wherein the average representative gray voltage level terminal is configured to apply a bottom electrode voltage to the first bottom electrode based on the average representative gray level.

19. The display panel of claim 16, each of the plurality of pixels further comprising a first reference transistor configured to apply a reference voltage to a node between the first and second compensating sub-transistors, wherein the average representative gray voltage level terminal is configured to receive the reference voltage based on the average representative gray level.

20. The display panel of claim 16, each of the plurality of pixels further comprising a switching transistor configured to transfer the data voltage to the source of the driving transistor.

* * * * *